US009220951B1

(12) United States Patent
Comeau

(10) Patent No.: US 9,220,951 B1
(45) Date of Patent: Dec. 29, 2015

(54) GOLF BALL CONSTRUCTIONS INCORPORATING STRUCTURALLY COLORED COMPOSITIONS

(71) Applicant: Acushnet Company, Fairhaven, MA (US)

(72) Inventor: Brian Comeau, Berkley, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 14/463,967

(22) Filed: Aug. 20, 2014

(51) Int. Cl.

| | |
|---|---|
| ***A63B 37/12*** | (2006.01) |
| ***A63B 37/14*** | (2006.01) |
| ***A63B 43/00*** | (2006.01) |
| ***A63B 37/00*** | (2006.01) |

(52) U.S. Cl.
CPC ..... *A63B 43/008* (2013.01); *A63B 37/0003* (2013.01); *A63B 37/0022* (2013.01); *A63B 37/0023* (2013.01); *A63B 37/12* (2013.01); *A63B 37/14* (2013.01); *A63B 37/00* (2013.01)

(58) Field of Classification Search
CPC .... A63B 37/12; A63B 37/0003; A63B 37/00; A63B 37/0022; A63B 37/0023; A63B 37/14
See application file for complete search history.

(56) References Cited

U.S. PATENT DOCUMENTS

2007/0178307 A1* 8/2007 Winkler ..... B82Y 20/00 428/403
2008/0015053 A1* 1/2008 Watanabe ..... A63B 37/0023 473/373
2010/0233146 A1* 9/2010 McDaniel ..... A01N 63/02 424/94.2
2012/0064309 A1* 3/2012 Kwon et al. ..... B82Y 20/00 428/195.1
2012/0129631 A1* 5/2012 Sullivan ..... A63B 37/0003 473/373
2012/0302690 A1* 11/2012 Cunningham ..... C08F 257/02 524/460
2013/0171438 A1* 7/2013 Hayashi ..... C08F 2/44 428/220
2013/0288035 A1* 10/2013 Baumberg ..... B29C 55/00 428/221
2014/0254017 A1* 9/2014 Manoharan ..... G02B 5/286 359/589
2014/0342849 A1* 11/2014 Morgan ..... A63B 37/0003 473/373

OTHER PUBLICATIONS

Brighter inks, without pigment; Manny Morone; Mar. 14, 2014; Harvard School of Engineering and Applied Sciences; 6 pages.
Photonic Structures in Biology: A Possible Blueprint for Nanotechnology; by Frank P. Barrows and Michael H. Bart; Nanomaterials and Nanotechnology.
Researchers develop non-iridescent, structural, full-spectrum pigments for reflective displays; Phys.Org; pp. 2.
The New Generation of Physical Effect Colorants; Faiz Rahman and Nigel P. Johnson; OPN Feb. 2008.

(Continued)

*Primary Examiner* — John E Simms, Jr.
(74) *Attorney, Agent, or Firm* — Margaret C. Barker

(57) ABSTRACT

A golf ball comprising a photonic pigmented layer formed from a layer composition and photonic pigments comprised of microcapsules having nanoparticles therein to create a predetermined overall golf ball color appearance. The nanoparticles are sized and spaced such that the diffraction and reflection of light creates the predetermined overall golf ball color appearance. The microcapsule may be UV curable/cured, and each microcapsule may have a diameter of from about 50 μm to about 150 μm. Each nanoparticle may comprise a nanoparticle core surrounded by a nanoparticle shell, the nanoparticle core having a diameter of from about 50 nm to about 100 nm, and the nanoparticle core and nanoparticle shell, combined, having a diameter of from about 120 nm to about 300 nm.

11 Claims, 1 Drawing Sheet

(56) References Cited

OTHER PUBLICATIONS

Pigment Design; Full-Spectrum Photonic Pigments with Non-iridescent Structural Colors through Colloidal Assembly; Jin-Gyu Park, Shin-Hyun Kim, Sofia Magkiriadou, Tae Min Choi, Young-Seok Kim, and Vinothan N. Manoharan;.
IOP Publishing; Physics of structural colors; S Kinoshita, S Yoshioka and J Miyazaki; Jun. 6, 2008;.

* cited by examiner

GOLF BALL CONSTRUCTIONS INCORPORATING STRUCTURALLY COLORED COMPOSITIONS

FIELD OF THE INVENTION

Golf balls having a permanent apparent color that is not subject to photodegradation from exposure to sunlight.

BACKGROUND OF THE INVENTION

Golf balls generally comprise a core surrounded by a cover and optionally intermediate layers there between. The cover forms a spherical outer surface and typically includes a plurality of dimples. The core and/or the cover may incorporate multiple layers and the core may be solid or have a fluid-filled center surrounded by windings and/or molded material. Golf ball covers may be formed from a variety of materials such as balata, polyurethane, polyurea, and/or thermoplastic compositions such as ionomer resins including SURLYN® and IOTEK®, depending upon the desired performance characteristics of the golf ball and desired properties of the cover.

While conventional golf balls are white, some golfers enjoy distinguishing themselves on the course by playing a golf ball having a unique visual appearance. Accordingly, golf ball manufacturers have incorporated coloring agents such as pigments, dyes, tints, inks and the like in golf ball materials and/or coatings.

Such color agents typically contain chromophores. A chromophore is the group of atoms within a molecule that is responsible for the molecule's color. Specifically, bonds between the atoms allow the atoms to absorb some visible light while reflecting other visible light, with the reflected wavelengths of light attributing a certain apparent color to the molecule.

A notable drawback with chromosphore-based coloring agents, however, is that the apparent color fades/discolors from exposure to sunlight due to photodegradation. This occurs because the atoms in a chromophore will also absorb damaging photons within the wavelengths found in sunlight (i.e., infrared radiation, visible light, and ultraviolet light), which break down the aforementioned bonds between atoms, thereby changing the atomic configuration within each chromophore. While stabilizer packages are often used to improve light stability, such improvement can be temporary. And stabilizer packages have been known to actually contribute to discoloration as well.

Accordingly, there remains a need for golf balls having an apparent surface color that is not subject to fading or discoloration when exposed to sun light. The present invention addresses and solves this need.

SUMMARY OF THE INVENTION

A golf ball of the invention comprises a photonic pigmented layer formed from a layer composition and photonic pigments comprised of microcapsules having nanoparticles therein to create a predetermined overall golf ball color appearance. The nanoparticles are sized and spaced such that the diffraction and reflection of light creates the predetermined overall golf ball color appearance.

The microcapsules may have a diameter within a range of from about 50 μm to about 150 μm, and may be UV curable/cured (i.e., by ultra violet radiation). Meanwhile, the nanoparticles may comprise a nanoparticle core surrounded by a nanoparticle shell. The nanoparticle core may have a diameter of from about 50 nm to about 100 nm, and the nanoparticle core and nanoparticle shell, combined, may have a diameter of from about 120 nm to about 300 nm. In one embodiment, the nanoparticle core and the nanoparticle shell are formed from different compositions.

In one non-limiting embodiment, the photonic pigmented layer is a cover layer. In another example, the photonic pigmented layer is a coating layer disposed about a cover layer.

The layer composition may be translucent or even transparent. Additionally, the layer composition may comprise an ionomer, a urethane, a latex, a lacquer, and/or an enamel. In this regard, the layer composition may be formed, for example, from at least one of an acrylic, an epoxy, a urethane acrylate, and an alkyd.

BRIEF DESCRIPTION OF THE DRAWINGS

The accompanying drawings form a part of the specification and are to be read in conjunction therewith. The illustrated embodiments, however, are merely examples and are not intended to be limiting. Like reference numerals and designations in the various drawings indicate like elements.

DETAILED DESCRIPTION

A golf ball of the invention desirably has a permanent predetermined overall golf ball color appearance that does not fade or discolor when exposed to sunlight because the surface color is produced based on the light scattering properties of a photonic pigmented layer formed from a layer composition and photonic pigments as defined herein rather than on chromophoric selective light absorption within wavelengths of visible light.

As used herein, the term "predetermined overall golf ball color appearance" refers to a targeted apparent surface color appearance as viewed from the golf ball spherically shaped outer surface and includes one or more colors within the wavelength of visible light (i.e., about 370 nm to about 800 nm) as measurable by a device known in the art for identifying/measuring color characteristics based on light scattering properties, diffraction and/or reflection.

Figure 1A:
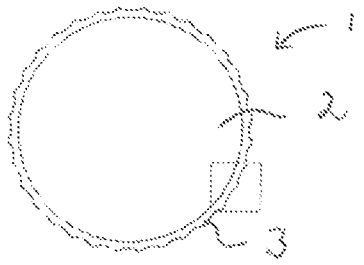
FIG. 1A is a cross-sectional view of a golf ball with a photonic pigmented layer in accordance with the present invention.

FIGS. 1A-1D depict one embodiment of a golf ball of the invention. Referring to FIG. 1A, golf ball 1 comprises core 2 surrounded by photonic pigmented layer 3. In FIG. 1A, photonic pigmented layer 3 is a cover layer. However, it is envisioned that a photonic pigmented layer may comprise any or all of a golf ball core, cover, intermediate layer(s) and coating layer(s), as long as the golf ball is otherwise constructed so as to permit nanoparticle cores within the photonic pigmented layer to diffract and reflect light and create the predetermined overall golf ball color appearance. For example, in one construction, an at least partially transparent/clear and/or translucent conventional coating layer surrounds photonic pigmented layer 3 (coating layer not shown in FIGS. 1A-1D). And in a particular embodiment, this surrounding coating layer is clear colored, comprising a conventional chromophore-based pigment.

Meanwhile, underlying/inner colored golf ball components, which photonic pigmented layer 3 surrounds, may also contribute to the golf ball's overall color appearance where layer composition 4 is at least partially transparent and/or translucent.

Figure 1B:
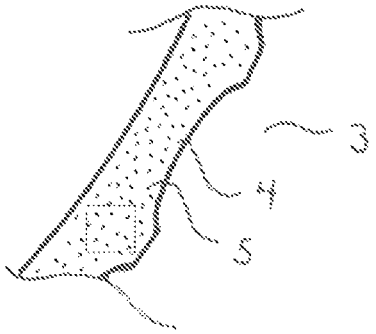
FIG. 1B is an enlarged view of the photonic pigmented layer section highlighted in FIG. 1A.

FIG. 1B is an enlarged section of photonic pigmented layer 3. As shown in FIG. 1B, photonic pigmented layer 3 is formed from layer composition 4 and photonic pigments 5. Embodiments are envisioned wherein a single golf ball layer incorporates both photonic pigments and a conventional chromophore-based pigment. For example, photonic pigmented layer 3 may comprise a chromophore-based pigmented layer composition 4 and photonic pigments 5, wherein each of layer composition 4 and photonic pigments 5 contribute to golf ball 1's predetermined overall golf ball color appearance.

Figure 1C:
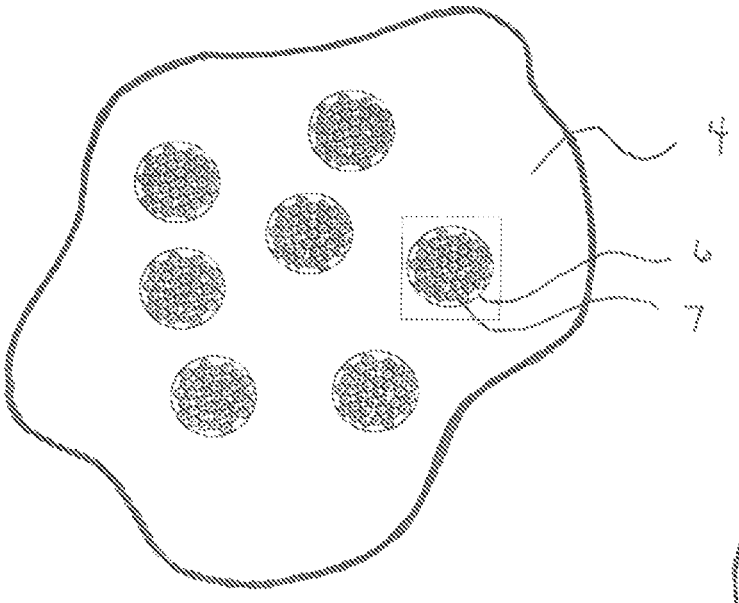
FIG. 1C is an enlarged view of the photonic pigmented layer section highlighted in FIG. 1B.
Figure 1D:
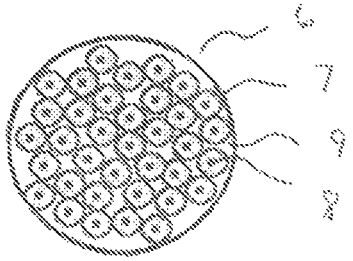
FIG. 1D is an enlarged view of the microcapsule highlighted in FIG. 1C.

FIG. 1C, an enlarged section of photonic pigmented layer 3 of FIG. 1B, depicts layer composition 4, microcapsules 6 with nanoparticles 7 therein (collectively, comprising the photonic pigments 5 of FIG. 1B). In turn, FIG. 1D is an enlarged microcapsule 6 of the FIG. 1C and shows that microcapsule 6 has a plurality of nanoparticles 7 therein, each nanoparticle 7 comprising a core 8 surrounded by a shell 9.

In a golf ball of the invention, the overall golf ball cover appearance may be targeted by manipulating the size and average spacing between the cores 8 of the core/shell nanoparticles 7 within each microcapsule 6 of the photonic pigmented layer 3. Collectively, the core/shell nanoparticles within the microcapsules possess unique light scattering properties in which coherent scattering dominates due to the amorphous nature of the nanoparticle packing. This leads to a structural color that is isotropic, independent from the angle of observation, and non-iridescent.

Each microcapsule may have a diameter, for example, within a range of from about 0.5 μm to about 150 μm, or from about 1.5 μm to about 130 μm, or from about 5 μm to about 110 μm, or from about 15 μm to about 90 μm, or from about 25 μm to about 70 μm, or from about 40 μm to about 50 μm. As used herein, the term "diameter" with respect to substantially spherical microcapsules and/or nanoparticles is the straight line that passes through the center and whose endpoints lie on the surface. Embodiments are envisioned wherein microcapsules are ground, milled or otherwise reduced in size prior to incorporation in a golf ball layer. Microcapsule size is not as critical as the sizing and spacing of nanoparticle cores.

Concerning non-spherical, asymmetric or irregularly shaped microcapsules and/or nanoparticles, the term characteristic length is used to describe the size of the microcapsules and/or nanoparticles. The characteristic length used herein is defined as the longest cross-section distance of the particle.

Of course, multiple length/diameter measurements may be made where a specific property measurement requires such (e.g., where a nanoparticle volume calculation requires measurement of both "longest distance between two surface points" and "shortest distance between two surface points", etc.).

Where a nanoparticle comprises a nanoparticle core surrounded by a nanoparticle shell, each may be formed from different compositions or comprise substantially similar compositions. In one embodiment, the nanoparticle core and nanoparticle shell, combined, may have a diameter within a range having a lower limit of from about 120 nm to about 300 nm, or from about 140 nm to about 280 nm, or from about 160 nm to about 260 nm, or from about 180 nm to about 240 nm, or from about 200 nm to about 220 nm.

Meanwhile, a nanoparticle core may have a diameter such as within a range having a lower limit of from about 50 nm to about 100 nm, or from about 60 nm to about 90 nm, or from about 70 nm to about 80 nm.

Embodiments are also envisioned, however, wherein the nanoparticle may comprise a single unit rather than having the core/shell type arrangement.

In some embodiments of a golf ball of the invention, the photonic pigments may be selected in terms of their respective volumes notwithstanding their particular shape(s). Any suitable method for determining microcapsules and/or nanoparticles volume as known in the art may be used. At least some volume calculations are, however, based on microcapsules and/or nanoparticles shape (e.g., being substantially spherical versus being asymmetrically shaped, etc.). For example, where a microcapsule or nanoparticle is substantially spherical, the volume thereof may be calculated using the formula $(4/3)\mu\pi r^3$, wherein $\pi=3.14$ and r is the radius of the sphere (i.e., ½ diameter).

In this regard, non-limiting suitable volumes for microcapsules and nanoparticles are as follows. For microcapsules, the volume may be within a range, for example, of from about 0.06 $nm^3$ to about $1.77\times10^6$ $\mu m^3$. For nanoparticles, the volume may be within a range, for example, of from about $9.05\times10^5$ $nm^3$ to about $1.41\times10^7$ $nm^3$.

The nanoparticle shell thickness is of particular significance in an embodiment wherein the nanoparticle core and nanoparticle shell are formed from different compositions and the nanoparticles are closely packed within the microcapsule such that adjacent shells are touching. In such an arrangement, the distance between two cores may be their combined adjacent shell thicknesses, and the predetermined overall golf ball color appearance may be modified, for example, by adjusting nanoparticle shell thickness. Herein, "adjacent" means bordering, and "touching" means "in contact" at some point along their respective outer surfaces.

In other embodiments, however, each nanoparticle has a center and an outer surface, wherein an entire outer surface of at least one of the nanoparticles is not in contact with any other outer surface.

In another embodiment, the distance between the cores of the core/shell nanoparticles can be controlled by droplet compression of the microcapsules by creating differences in the osmotic pressure between the microcapsule and the surrounding medium. The higher the osmotic concentration the smaller the microcapsules become, forcing the cores closer together and therefore tuning the observed color. Once the microcapsules have equilibrated at the adjusted osmotic pressure, the microcapsule can then be polymerized to lock in the spacing of the core/shell nanoparticles, which subsequently locks in the observed color.

Preferably, the photonic pigmented layer may comprise a plurality of microcapsules having substantially similar sizes, shapes and spacing there between. Alternatively, the microcapsules therein may have different sizes and/or shapes, and/or may have different spacing there between.

Similarly, the microcapsules preferably comprise a plurality of nanoparticles having substantially similar sizes and shapes and spacing there between. Alternatively, the nanoparticles therein may have different sizes and/or shapes, and/or may have different spacing there between.

In one embodiment, a golf ball of the invention comprises a photonic pigmented layer comprising at least one microcapsule and/or nanoparticle that is asymmetrically shaped. In another embodiment, a golf ball of the invention comprises a photonic pigmented layer comprising at least one microcapsule and/or nanoparticle that is symmetrically shaped.

It is contemplated that the layer composition itself may comprise any golf ball material that is combinable with photonic pigments to form a photonic pigmented layer that creates the predetermined overall golf ball color appearance based on the diffraction and reflection of light. Non-limiting examples of suitable layer compositions include ionomers, urethanes, latexes, lacquers, and/or enamels.

And a golf ball of the invention may have any construction which permits each photonic pigmented layer to create and/or contribute to the predetermined overall golf ball color appearance. This being said, a golf ball of the invention may include single a core or multi-layered core, and any number of intermediate layers, cover layers and/or coating layers. As used herein, the term "golf ball layer" or "layer" shall refer to inner cores (which are typically substantially spherical) in addition to other golf ball layers such as intermediate layers (e.g. outer core layers and/or inner cover layers), outer cover layers and coating layers.

For example, in one embodiment, a golf ball of the invention comprises a core, a cover and an intermediate layer disposed between the core and the cover, wherein the intermediate layer comprises the photonic pigmented layer. In another embodiment, a golf ball of the invention comprises an inner core, an outer core layer disposed about the inner core, and a cover surrounding the outer core layer, wherein the outer core layer comprises the photonic pigmented layer. In yet another embodiment, a golf ball of the invention comprises a core, a cover layer disposed about the core, and a coating layer formed about the cover, wherein the cover layer comprises the photonic pigmented layer. In still another embodiment, a golf ball of the invention comprises a core, a cover layer disposed about the core, and a coating layer formed about the cover, wherein the coating layer comprises the photonic pigmented layer.

Embodiments are also envisioned wherein at least two golf ball layers comprise photonic pigmented layers. For example, in one embodiment, a golf ball of the invention comprises an inner core, an outer core layer disposed about the inner core, a cover surrounding the outer core layer, and a coating layer formed about the cover layer, wherein both the cover layer and coating layer each comprise a photonic pigmented layer. In another embodiment, a golf ball of the invention comprises a core, a cover disposed about the core, a first coating layer disposed about the cover layer, and a second coating layer formed about the first coating layer, wherein the first coating layer and second coating layer each comprise a photonic pigmented layer.

Meanwhile, the saturation or intensity of a predetermined overall color appearance may be increased by raising the loading or weight percent (wt %) of microcapsules within a photonic pigmented layer. In one embodiment of a golf ball of the invention, the photonic pigmented layer comprises from about 2% to about 40% by weight (wt.) of the microcapsules. In one embodiment, the photonic pigmented layer comprises microcapsules in within a range of from about 5% by wt. of the microcapsules to about 35% by wt. of the microcapsules. In another embodiment, the photonic pigmented layer comprises microcapsules in within a range of from about 10% by wt. of the microcapsules to about 30% by wt. of the microcapsules. In yet another embodiment, the photonic pigmented layer comprises microcapsules in within a range of from about 15% by wt. of the microcapsules to about 25% by wt. of the microcapsules. In still another embodiment, the photonic pigmented layer comprises microcapsules in within a range of from about 5% by wt. of the microcapsules to about 15% by wt. of the microcapsules. In other embodiments, the photonic pigmented layer comprises microcapsules in within a range of from about 20% by wt. of the microcapsules to about 25% by wt. of the microcapsules, or from about 30% by wt. of the microcapsules to about 40% by wt. of the microcapsules, or from about 10% by wt. of the microcapsules to about 20% by wt. of the microcapsules, or from about 2% by wt. of the microcapsules to about 10% by wt. of the microcapsules.

The predetermined overall color appearance may comprise an "apparent surface color" comprising a visible color formed from reflection or diffraction of a range of wavelengths of visible light selected from violet, blue, green, yellow, orange, and red. In one embodiment, the microcapsules and nanoparticles therein are sized and spaced to create a predominantly violet color appearance with a peak wavelength of from about 390 nm to 455 nm. The peak wavelength is defined as the maximum value of the percent reflectance versus wavelength curve.

In another embodiment, the microcapsules and nanoparticles therein are sized and spaced to create a predominantly blue color appearance with a peak wavelength of from about 455 nm to 492 nm. In yet another embodiment, the microcapsules and nanoparticles therein are sized and spaced to create a predominantly green color appearance with a peak wavelength of from about 492 nm to 577 nm. In still another embodiment, the microcapsules and nanoparticles therein are sized and spaced to create a predominantly yellow color appearance with a peak wavelength of from about 577 nm to 597 nm. In an alternative embodiment, the microcapsules and nanoparticles therein are sized and spaced to create a predominantly orange color appearance with a peak wavelength of from about 597 nm to 620 nm. In a different embodiment, the microcapsules and nanoparticles therein are each sized and spaced to create a predominantly red color appearance with a peak wavelength of from about 620 nm to 780 nm.

In this regard, a specific predominant color appearance may be created by incorporating two or more substantially identical microcapsules in the photonic pigmented layer, each which creates an identical predominant color and attendant peak wavelength. Alternatively, two or more different microcapsules may be incorporated in the photonic pigmented layer whose different predominant colors and attendant peak wavelengths combine to produce the same predominant color appearance as created by incorporating the two or more substantially identical microcapsules in the photonic pigmented layer.

Shades such as pink, magenta, blue-green, green blue, red orange, orange red, yellow orange, orange red, red violet, violet red, blue violet, violet blue may also be created by incorporating two or more different microcapsules in a photonic pigmented layer. In the same fashion, apparently pearlescent, fluorescent and/or translucent and/or pastel color appearances may also be created by incorporating two or more different microcapsules in a photonic pigmented layer.

Additionally, the photonic pigmented layer can be at least partially translucent or transparent, for example, where the layer composition is translucent or transparent.

A golf ball of the invention may further have an outer surface comprising nano-surface texturing formed by a lattice of particles sized and spaced such that the diffraction and reflection of light creates a predetermined apparent surface color appearance. In another embodiment, a golf ball of the invention comprises an inner photonic pigmented layer and an outer photonic pigmented layer adjacent the inner photonic pigmented layer, wherein the refractive index of the inner photonic pigmented layer differs from the refractive index of the outer photonic pigmented layer periodically such that the diffraction and reflection of light creates a predetermined apparent surface color appearance.

The core may be made from a composition including at least one thermoset base rubber, such as a polybutadiene rubber, cured with at least one peroxide and at least one reactive co-agent, which can be a metal salt of an unsaturated carboxylic acid, such as acrylic acid or methacrylic acid, a non-metallic coagent, or mixtures thereof. Preferably, a suitable antioxidant is included in the composition. An optional soft and fast agent (and sometimes a cis-to-trans catalyst), such as an organosulfur or metal-containing organosulfur compound, can also be included in the core formulation.

Other ingredients that are known to those skilled in the art may be used, and are understood to include, but not be limited to, density-adjusting fillers, process aides, plasticizers, blowing or foaming agents, sulfur accelerators, and/or non-peroxide radical sources.

The base thermoset rubber, which can be blended with other rubbers and polymers, typically includes a natural or synthetic rubber. For example, the base rubber may be 1,4-polybutadiene having a cis structure of at least 40%, preferably greater than 80%, and more preferably greater than 90%.

Examples of desirable polybutadiene rubbers include BUNA® CB22 and BUNA® CB23, commercially available from LANXESS Corporation; UBEPOL® 360L and UBEPOL® 150L and UBEPOL-BR rubbers, commercially available from UBE Industries, Ltd. of Tokyo, Japan; BUDENE 1208, 1207, commercially available from Goodyear of Akron, Ohio; and CB BUNA® 1203G1, 1220, and 1221, commercially available from Dow Chemical Company; Europrene® NEOCIS® BR 40 and BR 60, commercially available from Polimeri Europa; and BR 01, BR 730, BR 735, BR 11, and BR 51, commercially available from Japan Synthetic Rubber Co., Ltd; and KARBOCHEM® ND40, ND45, and ND60, commercially available from Karbochem.

The base rubber may also comprise high or medium Mooney viscosity rubber, or blends thereof. A "Mooney" unit is a unit used to measure the resistance to flow of raw or unvulcanized rubber. The viscosity in a "Mooney" unit is equal to the torque, measured on an arbitrary scale, on a disk in a vessel that contains rubber at a temperature of 100° C. and rotates at two revolutions per minute. The measurement of Mooney viscosity is defined according to ASTM D-1646.

The Mooney viscosity range is preferably greater than about 40, more preferably in the range from about 40 to about 80 and more preferably in the range from about 40 to about 60. Polybutadiene rubber with higher Mooney viscosity may also be used, so long as the viscosity of the polybutadiene does not reach a level where the high viscosity polybutadiene adversely interferes with the manufacturing machinery. It is contemplated that polybutadiene with viscosity less than 65 Mooney can be used with the present invention.

In one embodiment of the present invention, golf ball cores made with mid- to high-Mooney viscosity polybutadiene material exhibit increased resiliency (and, therefore, distance) without increasing the hardness of the ball. Such cores are soft, i.e., compression less than about 60 and more specifically in the range of about 50-55. Cores with compression in the range of from about 30 about 50 are also within the range of this preferred embodiment.

Commercial sources of suitable mid- to high-Mooney viscosity polybutadiene include LANXESS CB23 (Nd-catalyzed), which has a Mooney viscosity of around 50 and is a highly linear polybutadiene. If desired, the polybutadiene can also be mixed with other elastomers known in the art, such as other polybutadiene rubbers, natural rubber, styrene butadiene rubber, and/or isoprene rubber in order to further modify the properties of the core. When a mixture of elastomers is used, the amounts of other constituents in the core composition are typically based on 100 parts by weight of the total elastomer mixture.

In one embodiment, the base rubber comprises a transition metal catalyst, a rare earth-catalyzed polybutadiene rubber, or blends thereof. If desired, the polybutadiene can also be mixed with other elastomers known in the art such as natural rubber, polyisoprene rubber and/or styrene-butadiene rubber in order to modify the properties of the core. Other suitable base rubbers include thermosetting materials such as, ethylene propylene diene monomer rubber, ethylene propylene rubber, butyl rubber, halobutyl rubber, hydrogenated nitrile butadiene rubber, nitrile rubber, and silicone rubber.

Thermoplastic elastomers (TPE) may also be used to modify the properties of the core layers, or the uncured core layer stock by blending with the base thermoset rubber. These TPEs include natural or synthetic balata, or high trans-polyisoprene, high trans-polybutadiene, or any styrenic block copolymer, such as styrene ethylene butadiene styrene, styrene-isoprene-styrene, etc., a metallocene or other single-site catalyzed polyolefin such as ethylene-octene, or ethylene-butene, or thermoplastic polyurethanes (TPU), including copolymers. Other suitable TPEs for blending with the thermoset rubbers of the present invention include PEBAX®, which is believed to comprise polyether amide copolymers, HYTREL®, which is believed to comprise polyether ester copolymers, thermoplastic urethane, and KRATON®, which is believed to comprise styrenic block copolymers elastomers. Any of the TPEs or TPUs above may also contain functionality suitable for grafting, including maleic acid or maleic anhydride.

Additional polymers may also optionally be incorporated into the base rubber. Examples include, but are not limited to, thermoset elastomers such as core regrind, thermoplastic vulcanizate, copolymeric ionomer, terpolymeric ionomer, polycarbonate, polyamide, copolymeric polyamide, polyesters, polyvinyl alcohols, acrylonitrile-butadiene-styrene copolymers, polyarylate, polyacrylate, polyphenylene ether, impact-modified polyphenylene ether, high impact polystyrene, diallyl phthalate polymer, styrene-acrylonitrile polymer (SAN) (including olefin-modified SAN and acrylonitrile-styrene-acrylonitrile polymer), styrene-maleic anhydride copolymer, styrenic copolymer, functionalized styrenic copolymer, functionalized styrenic terpolymer, styrenic terpolymer, cellulose polymer, liquid crystal polymer, ethylene-vinyl acetate copolymers, polyurea, and polysiloxane or any metallocene-catalyzed polymers of these species.

Suitable polyamides for use as an additional polymeric material in compositions within the scope of the present invention also include resins obtained by: (1) polycondensation of (a) a dicarboxylic acid, such as oxalic acid, adipic acid, sebacic acid, terephthalic acid, isophthalic acid, or 1,4-cyclohexanedicarboxylic acid, with (b) a diamine, such as ethylenediamine, tetramethylenediamine, pentamethylenediamine, hexamethylenediamine, or decamethylenediamine, 1,4-cyclohexanediamine, or m-xylylenediamine; (2) a ring-opening polymerization of cyclic lactam, such as Є-caprolactam or Ω-laurolactam; (3) polycondensation of an aminocarboxylic acid, such as 6-aminocaproic acid, 9-aminononanoic acid, 11-aminoundecanoic acid, or 12-aminododecanoic acid; or (4) copolymerization of a cyclic lactam with a dicarboxylic acid and a diamine. Specific examples of suitable polyamides include NYLON 6, NYLON 66, NYLON 610, NYLON 11, NYLON 12, copolymerized NYLON, NYLON MXD6, and NYLON 46.

Suitable peroxide initiating agents include dicumyl peroxide; 2,5-dimethyl-2,5-di(t-butylperoxy) hexane; 2,5-dimethyl-2,5-di(t-butylperoxy)hexyne; 2,5-dimethyl-2,5-di (benzoylperoxy)hexane; 2,2'-bis(t-butylperoxy)-di-isopropylbenzene; 1,1-bis(t-butylperoxy)-3,3,5-trimethyl cyclohexane; n-butyl 4,4-bis(t-butyl-peroxy)valerate; t-butyl perbenzoate; benzoyl peroxide; n-butyl 4,4'-bis(butylperoxy)

valerate; di-t-butyl peroxide; or 2,5-di-(t-butylperoxy)-2,5-dimethyl hexane, lauryl peroxide, t-butyl hydroperoxide, α-α bis(t-butylperoxy) diisopropylbenzene, di(2-t-butyl-peroxy-isopropyl)benzene, di-t-amyl peroxide, di-t-butyl peroxide. Preferably, the rubber composition includes from about 0.25 to about 5.0 parts by weight peroxide per 100 parts by weight rubber (phr), more preferably 0.5 phr to 3 phr, most preferably 0.5 phr to 1.5 phr. In another embodiment, the peroxide is present in an amount of about 0.8 phr. These ranges of peroxide are given assuming the peroxide is 100% active, without accounting for any carrier that might be present. Because many commercially available peroxides are sold along with a carrier compound, the actual amount of active peroxide present must be calculated. Commercially-available peroxide initiating agents include DICUP™ family of dicumyl peroxides (including DICUP™ R, DICUP™ 40C and DICUP™ 40KE) available from ARKEMA. Similar initiating agents are available from AkroChem, Lanxess, Flexsys/Harwick and R.T. Vanderbilt. Another commercially-available initiating agent is TRIGONOX™ 265-50B from Akzo Nobel, which is a mixture of 1,1-di(t-butylperoxy)-3,3,5-trimethylcyclohexane and di(2-t-butylperoxyisopropyl) benzene. TRIGONOX™ peroxides are generally sold on a carrier compound.

Suitable reactive co-agents include, but are not limited to, metal salts of diacrylates, dimethacrylates, and monomethacrylates suitable for use in this invention include those wherein the metal is zinc, magnesium, calcium, barium, tin, aluminum, lithium, sodium, potassium, iron, zirconium, and bismuth. Zinc diacrylate (ZDA) may be incorporated. ZDA provides golf balls with a high initial velocity. The ZDA can be of various grades of purity. For the purposes of this invention, the lower the quantity of zinc stearate present in the ZDA the higher the ZDA purity. ZDA containing less than about 10% zinc stearate is preferable. More preferable is ZDA containing about 4-8% zinc stearate. Suitable, commercially available zinc diacrylates include those from Cray Valley. For example, concentrations of ZDA that can be used are about 10 phr to about 40 phr, more preferably 20 phr to about 35 phr, most preferably 25 phr to about 35 phr. In one embodiment, the reactive co-agent is present in an amount of about 29 phr to about 31 phr.

Additional co-agents that may be used alone or in combination with those mentioned above include, but are not limited to, trimethylolpropane trimethacrylate, trimethylolpropane triacrylate, and the like. It is understood by those skilled in the art, that in the case where these co-agents may be liquids at room temperature, it may be advantageous to disperse these compounds on a suitable carrier to promote ease of incorporation in the rubber mixture.

Antioxidants are compounds that inhibit or prevent the oxidative breakdown of elastomers, and/or inhibit or prevent reactions that are promoted by oxygen radicals. Some exemplary antioxidants that may be used in the present invention include, but are not limited to, quinoline type antioxidants, amine type antioxidants, and phenolic type antioxidants. One antioxidant is 2,2'-methylene-bis-(4-methyl-6-t-butylphenol) available as VANOX® MBPC from R.T. Vanderbilt. Other polyphenolic antioxidants include VANOX® T, VANOX® L, VANOX® SKT, VANOX® SWP, VANOX® 13 and VANOX® 1290.

Suitable antioxidants include, but are not limited to, alkylene-bis-alkyl substituted cresols, such as 4,4'-methylene-bis (2,5-xylenol); 4,4'-ethylidene-bis-(6-ethyl-m-cresol); 4,4'-butylidene-bis-(6-t-butyl-m-cresol); 4,4'-decylidene-bis-(6-methyl-m-cresol); 4,4'-methylene-bis-(2-amyl-m-cresol); 4,4'-propylidene-bis-(5-hexyl-m-cresol); 3,3'-decylidene-bis-(5-ethyl-p-cresol); 2,2'-butylidene-bis-(3-n-hexyl-p-cresol); 4,4'-(2-butylidene)-bis-(6-t-butyl-m-cresol); 3,3'-4 (decylidene)-bis-(5-ethyl-p-cresol); (2,5-dimethyl-4-hydroxyphenyl) (2-hydroxy-3,5-dimethylphenyl) methane; (2-methyl-4-hydroxy-5-ethylphenyl) (2-ethyl-3-hydroxy-5-methylphenyl) methane; (3-methyl-5-hydroxy-6-t-butylphenyl) (2-hydroxy-4-methyl-5-decylphenyl)-n-butyl methane; (2-hydroxy-4-ethyl-5-methylphenyl) (2-decyl-3-hydroxy-4-methylphenyl)butylamylmethane; (3-ethyl-4-methyl-5-hydroxyphenyl)-(2,3-dimethyl-3-hydroxy-phenyl)nonylmethane; (3-methyl-2-hydroxy-6-ethylphenyl)-(2-isopropyl-3-hydroxy-5-methyl-phenyl)cyclohexylmethane; (2-methyl-4-hydroxy-5-methylphenyl) (2-hydroxy-3-methyl-5-ethylphenyl)dicyclohexyl methane; and the like.

Other suitable antioxidants include, but are not limited to, substituted phenols, such as 2-tert-butyl-4-methoxyphenol; 3-tert-butyl-4-methoxyphenol; 3-tert-octyl-4-methoxyphenol; 2-methyl-4-methoxyphenol; 2-stearyl-4-n-butoxyphenol; 3-t-butyl-4-stearyloxyphenol; 3-lauryl-4-ethoxyphenol; 2,5-di-t-butyl-4-methoxyphenol; 2-methyl-4-methoxyphenol; 2-(1-methycyclohexyl)-4-methoxyphenol; 2-t-butyl-4-dodecyloxyphenol; 2-(1-methylbenzyl)-4-methoxyphenol; 2-t-octyl-4-methoxyphenol; methyl gallate; n-propyl gallate; n-butyl gallate; lauryl gallate; myristyl gallate; stearyl gallate; 2,4,5-trihydroxyacetophenone; 2,4,5-trihydroxy-n-butyrophenone; 2,4,5-trihydroxystearophenone; 2,6-ditert-butyl-4-methylphenol; 2,6-ditert-octyl-4-methylphenol; 2,6-ditert-butyl-4-stearylphenol; 2-methyl-4-methyl-6-tert-butylphenol; 2,6-distearyl-4-methylphenol; 2,6-dilauryl-4-methylphenol; 2,6-di(n-octyl)-4-methylphenol; 2,6-di(n-hexadecyl)-4-methylphenol; 2,6-di(1-methylundecyl)-4-methylphenol; 2,6-di(1-methylheptadecyl)-4-methylphenol; 2,6-di(trimethylhexyl)-4-methylphenol; 2,6-di(1,1,3,3-tetramethyloctyl)-4-methylphenol; 2-n-dodecyl-6-tert butyl-4-methylphenol; 2-n-dodecyl-6-(1-methylundecyl)-4-methylphenol; 2-n-dodecyl-6-(1,1,3,3-tetramethyloctyl)-4-methylphenol; 2-n-dodecyl-6-n-octadecyl-4-methylphenol; 2-n-dodecyl-6-n-octyl-4-methylphenol; 2-methyl-6-n-octadecyl-4-methylphenol; 2-n-dodecyl-6-(1-methylheptadecyl)-4-methylphenol; 2,6-di(1-methylbenzyl)-4-methylphenol; 2,6-di(1-methylcyclohexyl)-4-methylphenol; 2,6-(1-methylcyclohexyl)-4-methylphenol; 2-(1-methylbenzyl)-4-methylphenol; and related substituted phenols.

More suitable antioxidants include, but are not limited to, alkylene bisphenols, such as 4,4'-butylidene bis(3-methyl-6-t-butyl phenol); 2,2-butylidene bis (4,6-dimethyl phenol); 2,2'-butylidene bis(4-methyl-6-t-butyl phenol); 2,2'-butylidene bis(4-t-butyl-6-methyl phenol); 2,2'-ethylidene bis(4-methyl-6-t-butylphenol); 2,2'-methylene bis(4,6-dimethyl phenol); 2,2'-methylene bis(4-methyl-6-t-butyl phenol); 2,2'-methylene bis(4-ethyl-6-t-butyl phenol); 4,4'-methylene bis (2,6-di-t-butyl phenol); 4,4'-methylene bis(2-methyl-6-t-butyl phenol); 4,4'-methylene bis(2,6-dimethyl phenol); 2,2'-methylene bis(4-t-butyl-6-phenyl phenol); 2,2'-dihydroxy-3,3',5,5'-tetramethylstilbene; 2,2'-isopropylidene bis(4-methyl-6-t-butyl phenol); ethylene bis (beta-naphthol); 1,5-dihydroxy naphthalene; 2,2'-ethylene bis (4-methyl-6-propyl phenol); 4,4'-methylene bis(2-propyl-6-t-butyl phenol); 4,4'-ethylene bis (2-methyl-6-propyl phenol); 2,2'-methylene bis (5-methyl-6-t-butyl phenol); and 4,4'-butylidene bis(6-t-butyl-3-methyl phenol);

Suitable antioxidants further include, but are not limited to, alkylene trisphenols, such as 2,6-bis (2'-hydroxy-3'-t-butyl-5'-methyl benzyl)-4-methyl phenol; 2,6-bis (2'-hydroxy-3'-t-ethyl-5'-butyl benzyl)-4-methyl phenol; and 2,6-bis(2'-hydroxy-3'-t-butyl-5'-propyl benzyl)-4-methyl phenol.

The antioxidant is typically present in an amount of about 0.1 phr to about 5 phr, preferably from about 0.1 phr to about 2 phr, more preferably about 0.1 phr to about 1 phr. In one embodiment, the antioxidant is present in an amount of about 0.4 phr. In an alternative embodiment, the antioxidant should be present in an amount to ensure that the hardness gradient of the inventive cores is negative. Preferably, about 0.2 phr to about 1 phr antioxidant is added to the core layer (inner core or outer core layer) formulation, more preferably, about 0.3 to about 0.8 phr, and most preferably 0.4 to about 0.7 phr. Preferably, about 0.25 phr to about 1.5 phr of peroxide as calculated at 100% active can be added to the core formulation, more preferably about 0.5 phr to about 1.2 phr, and most preferably about 0.7 phr to about 1.0 phr. The ZDA amount can be varied to suit the desired compression, spin and feel of the resulting golf ball. The cure regime can have a temperature range between from about 290° F. to about 360° F., or from about 290° F. to about 335° F., or from about 300° F. to about 325° F., or from about 330° F. to about 355° F., and the stock is held at that temperature for at least about 10 minutes to about 30 minutes.

The thermoset rubber composition in a core of the golf ball of the present invention may also include an optional soft and fast agent. As used herein, "soft and fast agent" means any compound or a blend thereof that that is capable of making a core 1) be softer (lower compression) at constant COR or 2) have a higher COR at equal compression, or any combination thereof, when compared to a core equivalently prepared without a soft and fast agent. Preferably, the composition of the present invention contains from about 0.05 phr to about 10.0 phr soft and fast agent. In one embodiment, the soft and fast agent is present in an amount of about 0.05 phr to about 3.0 phr, preferably about 0.05 phr to about 2.0 phr, more preferably about 0.05 phr to about 1.0 phr. In another embodiment, the soft and fast agent is present in an amount of about 2.0 phr to about 5.0 phr, preferably about 2.35 phr to about 4.0 phr, and more preferably about 2.35 phr to about 3.0 phr. In an alternative high concentration embodiment, the soft and fast agent is present in an amount of about 5.0 phr to about 10.0 phr, more preferably about 6.0 phr to about 9.0 phr, most preferably about 7.0 phr to about 8.0 phr. In another embodiment, the soft and fast agent is present in an amount of about 2.6 phr.

Suitable soft and fast agents include, but are not limited to, organosulfur or metal-containing organosulfur compounds, an organic sulfur compound, including mono, di, and polysulfides, a thiol, or mercapto compound, an inorganic sulfide compound, a Group VIA compound, or mixtures thereof. The soft and fast agent component may also be a blend of an organosulfur compound and an inorganic sulfide compound.

Suitable soft and fast agents of the present invention include, but are not limited to those having the following general formula:

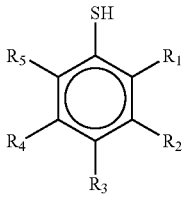

where $R_1$-$R_5$ can be $C_1$-$C_8$ alkyl groups; halogen groups; thiol groups (—SH), carboxylated groups; sulfonated groups; and hydrogen; in any order; and also pentafluorothiophenol; 2-fluorothiophenol; 3-fluorothiophenol; 4-fluorothiophenol; 2,3-fluorothiophenol; 2,4-fluorothiophenol; 3,4-fluorothiophenol; 3,5-fluorothiophenol 2,3,4-fluorothiophenol; 3,4,5-fluorothiophenol; 2,3,4,5-tetrafluorothiophenol; 2,3,5,6-tetrafluorothiophenol; 4-chlorotetrafluorothiophenol; pentachlorothiophenol; 2-chlorothiophenol; 3-chlorothiophenol; 4-chlorothiophenol; 2,3-chlorothiophenol; 2,4-chlorothiophenol; 3,4-chlorothiophenol; 3,5-chlorothiophenol; 2,3,4-chlorothiophenol; 3,4,5-chlorothiophenol; 2,3,4,5-tetrachlorothiophenol; 2,3,5,6-tetrachlorothiophenol; pentabromothiophenol; 2-bromothiophenol; 3-bromothiophenol; 4-bromothiophenol; 2,3-bromothiophenol; 2,4-bromothiophenol; 3,4-bromothiophenol; 3,5-bromothiophenol; 2,3,4-bromothiophenol; 3,4,5-bromothiophenol; 2,3,4,5-tetrabromothiophenol; 2,3,5,6-tetrabromothiophenol; pentaiodothiophenol; 2-iodothiophenol; 3-iodothiophenol; 4-iodothiophenol; 2,3-iodothiophenol; 2,4-iodothiophenol; 3,4-iodothiophenol; 3,5-iodothiophenol; 2,3,4-iodothiophenol; 3,4,5-iodothiophenol; 2,3,4,5-tetraiodothiophenol; 2,3,5,6-tetraiodothiophenoland; and their zinc salts. Preferably, the halogenated thiophenol compound is pentachlorothiophenol, which is commercially available in neat form or under the tradename STRUKTOL®, a clay-based carrier containing the sulfur compound pentachlorothiophenol loaded at 45 percent (correlating to 2.4 parts PCTP). STRUKTOL® is commercially available from Struktol Company of America of Stow, Ohio. PCTP is commercially available in neat form from eChinachem of San Francisco, Calif. and in the salt form from eChinachem of San Francisco, Calif. Most preferably, the halogenated thiophenol compound is the zinc salt of pentachlorothiophenol, which is commercially available from eChinachem of San Francisco, Calif.

As used herein when referring to the invention, the term "organosulfur compound(s)" refers to any compound containing carbon, hydrogen, and sulfur, where the sulfur is directly bonded to at least 1 carbon. As used herein, the term "sulfur compound" means a compound that is elemental sulfur, polymeric sulfur, or a combination thereof. It should be further understood that the term "elemental sulfur" refers to the ring structure of $S_8$ and that "polymeric sulfur" is a structure including at least one additional sulfur relative to elemental sulfur.

Additional suitable examples of soft and fast agents (that are also believed to be cis-to-trans catalysts) include, but are not limited to, 4,4'-diphenyl disulfide; 4,4'-ditolyl disulfide; 2,2'-benzamido diphenyl disulfide; bis(2-aminophenyl) disulfide; bis(4-aminophenyl) disulfide; bis(3-aminophenyl) disulfide; 2,2'-bis(4-aminonaphthyl) disulfide; 2,2'-bis(3-aminonaphthyl) disulfide; 2,2'-bis(4-aminonaphthyl) disulfide; 2,2'-bis(5-aminonaphthyl) disulfide; 2,2'-bis(6-aminonaphthyl) disulfide; 2,2'-bis(7-aminonaphthyl) disulfide; 2,2'-bis(8-aminonaphthyl) disulfide; 1,1'-bis(2-aminonaphthyl) disulfide; 1,1'-bis(3-aminonaphthyl) disulfide; 1,1'-bis(3-aminonaphthyl) disulfide; 1,1'-bis(4-aminonaphthyl) disulfide; 1,1'-bis(5-aminonaphthyl) disulfide; 1,1'-bis(6-aminonaphthyl) disulfide; 1,1'-bis(7-aminonaphthyl) disulfide; 1,1'-bis(8-aminonaphthyl) disulfide; 1,2'-diamino-1,2'-dithiodinaphthalene; 2,3'-diamino-1,2'-dithiodinaphthalene; bis(4-chlorophenyl) disulfide; bis(2-chlorophenyl) disulfide; bis(3-chlorophenyl) disulfide; bis(4-bromophenyl) disulfide; bis(2-bromophenyl) disulfide; bis(3-bromophenyl) disulfide; bis(4-fluorophenyl) disulfide; bis(4-iodophenyl) disulfide; bis(2,5-dichlorophenyl) disulfide; bis(3,5-dichlorophenyl) disulfide; bis (2,4-dichlorophenyl) disulfide; bis(2,6-dichlorophenyl) disulfide; bis(2,5-dibromophenyl) disulfide; bis(3,5-dibromophenyl) disulfide; bis(2-chloro-5-bromophenyl) disulfide; bis(2,4,6-trichlorophenyl) disulfide; bis(2,3,4,5,6-pentachlorophenyl) disulfide; bis(4-cyanophenyl) disulfide;

bis(2-cyanophenyl) disulfide; bis(4-nitrophenyl) disulfide; bis(2-nitrophenyl) disulfide; 2,2'-dithiobenzoic acid ethylester; 2,2'-dithiobenzoic acid methylester; 2,2'-dithiobenzoic acid; 4,4'-dithiobenzoic acid ethylester; bis(4-acetylphenyl) disulfide; bis(2-acetylphenyl) disulfide; bis(4-formylphenyl) disulfide; bis(4-carbamoylphenyl) disulfide; 1,1'-dinaphthyl disulfide; 2,2'-dinaphthyl disulfide; 1,2'-dinaphthyl disulfide; 2,2'-bis(1-chlorodinaphthyl) disulfide; 2,2'-bis(1-bromonaphthyl) disulfide; 1,1'-bis(2-chloronaphthyl) disulfide; 2,2'-bis(1-cyanonaphthyl) disulfide; 2,2'-bis(1-acetylnaphthyl) disulfide; and the like; or a mixture thereof. Preferred organosulfur components include 4,4'-diphenyl disulfide, 4,4'-ditolyl disulfide, or 2,2'-benzamido diphenyl disulfide, or a mixture thereof. A more preferred organosulfur component includes 4,4'-ditolyl disulfide. In another embodiment, metal-containing organosulfur components can be used according to the invention. Suitable metal-containing organosulfur components include, but are not limited to, cadmium, copper, lead, and tellurium analogs of diethyldithiocarbamate, diamyldithiocarbamate, and dimethyldithiocarbamate, or mixtures thereof.

Suitable substituted or unsubstituted aromatic organic components that do not include sulfur or a metal include, but are not limited to, 4,4'-diphenyl acetylene, azobenzene, or a mixture thereof. The aromatic organic group preferably ranges in size from $C_6$ to $C_{20}$, and more preferably from $C_6$ to $C_{10}$. Suitable inorganic sulfide components include, but are not limited to titanium sulfide, manganese sulfide, and sulfide analogs of iron, calcium, cobalt, molybdenum, tungsten, copper, selenium, yttrium, zinc, tin, and bismuth.

A substituted or unsubstituted aromatic organic compound is also suitable as a soft and fast agent. Suitable substituted or unsubstituted aromatic organic components include, but are not limited to, components having the formula $(R_1)_x$—$R_3$-M-$R_4$—$(R_2)_y$, wherein $R_1$ and $R_2$ are each hydrogen or a substituted or unsubstituted $C_{1-20}$ linear, branched, or cyclic alkyl, alkoxy, or alkylthio group, or a single, multiple, or fused ring $C_6$ to $C_{24}$ aromatic group; x and y are each an integer from 0 to 5; $R_3$ and $R_4$ are each selected from a single, multiple, or fused ring $C_6$ to $C_{24}$ aromatic group; and M includes an azo group or a metal component. $R_3$ and $R_4$ are each preferably selected from a $C_6$ to $C_{10}$ aromatic group, more preferably selected from phenyl, benzyl, naphthyl, benzamido, and benzothiazyl. $R_1$ and $R_2$ are each preferably selected from a substituted or unsubstituted $C_{1-10}$ linear, branched, or cyclic alkyl, alkoxy, or alkylthio group or a $C_6$ to $C_{10}$ aromatic group. When $R_1$, $R_2$, $R_3$, or $R_4$, are substituted, the substitution may include one or more of the following substituent groups: hydroxy and metal salts thereof; mercapto and metal salts thereof; halogen; amino, nitro, cyano, and amido; carboxyl including esters, acids, and metal salts thereof; silyl; acrylates and metal salts thereof; sulfonyl or sulfonamide; and phosphates and phosphites. When M is a metal component, it may be any suitable elemental metal available to those of ordinary skill in the art. Typically, the metal will be a transition metal, although preferably it is tellurium or selenium. In one embodiment, the aromatic organic compound is substantially free of metal, while in another embodiment the aromatic organic compound is completely free of metal.

The soft and fast agent can also include a Group VIA component. Elemental sulfur and polymeric sulfur are commercially available from Elastochem, Inc. of Chardon, Ohio Exemplary sulfur catalyst compounds include PB(RM-S)-80 elemental sulfur and PB(CRST)-65 polymeric sulfur, each of which is available from Elastochem, Inc. An exemplary tellurium catalyst under the tradename TELLOY® and an exemplary selenium catalyst under the tradename VANDEX® are each commercially available from RT Vanderbilt.

Fillers may also be added to the thermoset rubber composition of the core to adjust the density of the composition, up or down. Typically, fillers include materials such as tungsten, zinc oxide, barium sulfate, silica, calcium carbonate, zinc carbonate, metals, metal oxides and salts, regrind (recycled core material typically ground to about 30 mesh particle), high-Mooney-viscosity rubber regrind, trans-regrind core material (recycled core material containing high trans-isomer of polybutadiene), and the like. When trans-regrind is present, the amount of trans-isomer is preferably between about 10% and about 60%. In one embodiment of the invention, the core comprises polybutadiene having a cis-isomer content of greater than about 95% and trans-regrind core material (already vulcanized) as a filler. Any particle size trans-regrind core material is sufficient, but is preferably less than about 125 μm.

Fillers added to one or more portions of the golf ball typically include processing aids or compounds to affect rheological and mixing properties, density-modifying fillers, tear strength, or reinforcement fillers, and the like. The fillers are generally inorganic, and suitable fillers include numerous metals or metal oxides, such as zinc oxide and tin oxide, as well as barium sulfate, zinc sulfate, calcium carbonate, barium carbonate, clay, tungsten, tungsten carbide, an array of silicas, and mixtures thereof. Fillers may also include various foaming agents or blowing agents which may be readily selected by one of ordinary skill in the art. Fillers may include polymeric, ceramic, metal, and glass microspheres may be solid or hollow, and filled or unfilled. Fillers are typically also added to one or more portions of the golf ball to modify the density thereof to conform to uniform golf ball standards. Fillers may also be used to modify the weight of the center or at least one additional layer for specialty balls, e.g., a lower weight ball is preferred for a player having a low swing speed.

Materials such as tungsten, zinc oxide, barium sulfate, silica, calcium carbonate, zinc carbonate, metals, metal oxides and salts, and regrind (recycled core material typically ground to about 30 mesh particle) are also suitable fillers.

The polybutadiene and/or any other base rubber or elastomer system may also be foamed, or filled with hollow microspheres or with expandable microspheres which expand at a set temperature during the curing process to any low specific gravity level. Other ingredients such as sulfur accelerators, e.g., tetramethylthiuram di, tri, or tetrasulfide, and/or metal-containing organosulfur components may also be used according to the invention. Suitable metal-containing organosulfur accelerators include, but are not limited to, cadmium, copper, lead, and tellurium analogs of diethyldithiocarbamate, diamyldithiocarbamate, and dimethyldithiocarbamate, or mixtures thereof. Other ingredients such as processing aids e.g., fatty acids and/or their metal salts, processing oils, dyes and pigments, as well as other additives known to one skilled in the art may also be used in the present invention in amounts sufficient to achieve the purpose for which they are typically used.

Without being bound by theory, it is believed that the percentage of double bonds in the trans configuration may be manipulated throughout a core containing at least one main-chain unsaturated rubber (i.e., polybutadiene), plastic, or elastomer resulting in a trans gradient. The trans gradient may be influenced (up or down) by changing the type and amount of cis-to-trans catalyst (or soft-and-fast agent), the type and amount of peroxide, and the type and amount of coagent in the formulation. For example, a formulation containing about 0.25 phr ZnPCTP may have a trans gradient of about 5% across the core whereas a formulation containing about 2 phr ZnPCTP may have a trans gradient of about 10%, or higher. The trans gradient may also be manipulated through the cure times and temperatures. It is believed that lower temperatures and shorter cure times yield lower trans gradients, although a combination of many of these factors may yield gradients of differing and/or opposite directions from that resulting from use of a single factor.

In general, higher and/or faster cure rates tend to yield higher levels of trans content, as do higher concentrations of peroxides, soft-and-fast agents, and, to some extent, ZDA concentration. Even the type of rubber may have an effect on trans levels, with those catalyzed by rare-earth metals, such as Nd, being able to form higher levels of trans polybutadiene compared to those rubbers formed from Group VIII metals, such as Co, Ni, and Li.

It will be appreciated that a golf ball according to the invention may display a hardness gradient. Cores may have an outer surface and a center and be formed from a substantially homogenous rubber composition. In some embodiments, a hardness of the outer surface of the core differs from a hardness of the geometric center as defined herein. In other embodiments, the hardness of the outer surface and hardness of the geometric center do not differ. Additionally, a core may have a 'dual core' arrangement, including a center or inner core and at least one outer core layer, with hardness gradients within each of the inner core and/or outer core layer and between each layer as well.

The center hardness of a core is obtained according to the following procedure. The core is gently pressed into a hemispherical holder having an internal diameter approximately slightly smaller than the diameter of the core, such that the core is held in place in the hemispherical portion of the holder while concurrently leaving the geometric central plane of the core exposed. The core is secured in the holder by friction, such that it will not move during the cutting and grinding steps, but the friction is not so excessive that distortion of the natural shape of the core would result. The core is secured such that the parting line of the core is roughly parallel to the top of the holder. The diameter of the core is measured 90 degrees to this orientation prior to securing. A measurement is also made from the bottom of the holder to the top of the core to provide a reference point for future calculations. A rough cut is made slightly above the exposed geometric center of the core using a band saw or other appropriate cutting tool, making sure that the core does not move in the holder during this step. The remainder of the core, still in the holder, is secured to the base plate of a surface grinding machine. The exposed 'rough' surface is ground to a smooth, flat surface, revealing the geometric center of the core, which can be verified by measuring the height from the bottom of the holder to the exposed surface of the core, making sure that exactly half of the original height of the core, as measured above, has been removed to within ±0.004 in. Leaving the core in the holder, the center of the core is found with a center square and carefully marked and the hardness is measured at the center mark according to ASTM D-2240. Additional hardness measurements at any distance from the center of the core can then be made by drawing a line radially outward from the center mark, and measuring the hardness at any given distance along the line, typically in 2 mm increments from the center. The hardness at a particular distance from the center should be measured along at least two, preferably four, radial arms located 180° apart, or 90° apart, respectively, and then averaged. All hardness measurements performed on a plane passing through the geometric center are performed while the core is still in the holder and without having disturbed its orientation, such that the test surface is constantly parallel to the bottom of the holder, and thus also parallel to the properly aligned foot of the durometer.

The hardness of a core may be measured by taking measurements at the center of the core and radially outward toward the surface of the core, typically at 2-mm increments. As used herein, the terms "negative" and "positive" refer to the result of subtracting the hardness value at the innermost portion of the component being measured (e.g., the center of a core) from the hardness value at the outer surface of the component being measured (e.g., the outer surface of the single core or the outer surface of an outer core layer in a dual core arrangement, etc.).

The center hardness of a core and the outer surfaces of a single core or outer core layer in a multi-layer core arrangement are readily determined according to the procedures given herein if the measurement is made prior to surrounding the layer with an additional core layer.

Once an additional core layer surrounds a layer of interest, the hardness of the inner and outer surfaces of any inner or intermediate layers can be difficult to determine so that a different procedure detailed below may be used for measuring a point located 1 mm from an interface is used. The hardness of a golf ball layer at a point located 1 mm from an interface is obtained according to the following procedure. First, an axis defining the geometric center of the core is revealed by preparing the core according to the above procedure for measuring the center hardness of a core. Leaving the core in the holder, a point located 1 mm radially inward or outward from the interface of two layers is determined and marked, and the hardness thereof is measured according to ASTM D-2240.

The outer surface hardness of a golf ball layer is measured on the actual outer surface of the layer and is obtained from the average of a number of measurements taken from opposing hemispheres, taking care to avoid making measurements on the parting line of the core or on surface defects, such as holes or protrusions. Hardness measurements are made pursuant to ASTM D-2240 "Indentation Hardness of Rubber and Plastic by Means of a Durometer." Because of the curved surface, care must be taken to insure that the golf ball or golf ball subassembly is centered under the durometer indentor before a surface hardness reading is obtained. A calibrated, digital durometer, capable of reading to 0.1 hardness units is used for all hardness measurements and the maximum reading is obtained. The digital durometer must be attached to, and its foot made parallel to, the base of an automatic stand. The weight on the durometer and attack rate conform to ASTM D-2240.

The ratio of antioxidant to initiator is one factor to control the surface hardness of the cores.

In one embodiment, the hardness of the core at the surface is at most about the same as or different than the hardness of the core at the center as defined herein. Furthermore, the center hardness of the core may not be the hardest point in the core. Additionally, the lowest hardness anywhere in the core does not have to occur at the surface. In some embodiments, the lowest hardness value occurs within about the outer 6 mm of the core surface. However, the lowest hardness value within the core can occur at any point from the surface, up to, but not including the center. The formulation is the same throughout the core, or core layer, and no surface treatment is applied to the core to obtain the preferred surface hardness.

Golf ball components such as cores, intermediate layers and covers may be made from a variety of materials. In one embodiment, an intermediate layer is formed from an ionomeric material including ionomeric polymers, preferably highly-neutralized ionomers (HNP). In another embodiment, the intermediate layer of the golf ball is formed from an HNP material or a blend of HNP materials. The acid moieties of the HNP's, typically ethylene-based ionomers, are preferably neutralized greater than about 70%, more preferably greater than about 90%, and most preferably at least about 100%. The HNP's can be also be blended with a second polymer component, which, if containing an acid group, may also be neutralized. The second polymer component, which may be partially or fully neutralized, preferably comprises ionomeric copolymers and terpolymers, ionomer precursors, thermoplastics, polyamides, polycarbonates, polyesters, polyurethanes, polyureas, thermoplastic elastomers, polybutadiene rubber, balata, metallocene-catalyzed polymers (grafted and non-grafted), single-site polymers, high-crystalline acid polymers, cationic ionomers, and the like. HNP polymers typically have a material hardness of between about 20 and about 80 Shore D, and a flexural modulus of between about 3,000 psi and about 200,000 psi.

Non-limiting examples of suitable ionomers include partially neutralized ionomers, blends of two or more partially neutralized ionomers, highly neutralized ionomers, blends of two or more highly neutralized ionomers, and blends of one or more partially neutralized ionomers with one or more highly neutralized ionomers. Methods of preparing ionomers are well known, and are disclosed, for example, in U.S. Pat. No. 3,264,272, the entire disclosure of which is hereby incorporated herein by reference. The acid copolymer can be a direct copolymer wherein the polymer is polymerized by adding all monomers simultaneously, as disclosed, for example, in U.S. Pat. No. 4,351,931, the entire disclosure of which is hereby incorporated herein by reference. Alternatively, the acid copolymer can be a graft copolymer wherein a monomer is grafted onto an existing polymer, as disclosed, for example, in U.S. Patent Application Publication No. 2002/0013413, the entire disclosure of which is hereby incorporated herein by reference.

In one embodiment of the present invention the HNP's are ionomers and/or their acid precursors that are preferably neutralized, either fully or partially, with a suitable base. The acid copolymers are preferably α-olefin, such as ethylene, $C_{3-8}$ α,β-ethylenically unsaturated carboxylic acid, such as acrylic and methacrylic acid, copolymers. They may optionally contain a softening monomer, such as alkyl acrylate and alkyl methacrylate, wherein the alkyl groups have from 1 to 8 carbon atoms.

The acid copolymers can be described as E/X/Y copolymers where E is ethylene, X is an α,β-ethylenically unsaturated carboxylic acid, and Y is a softening comonomer. In a one embodiment, X is acrylic or methacrylic acid and Y is a $C_{1-8}$ alkyl acrylate or methacrylate ester. X is preferably present in an amount from about 1 to about 35 weight percent of the polymer, more preferably from about 5 to about 30 weight percent of the polymer, and most preferably from about 10 to about 20 weight percent of the polymer. Y is preferably present in an amount from about 0 to about 50 weight percent of the polymer, more preferably from about 5 to about 25 weight percent of the polymer, and most preferably from about 10 to about 20 weight percent of the polymer.

Specific acid-containing ethylene copolymers include, but are not limited to, ethylene/acrylic acid/n-butyl acrylate, ethylene/methacrylic acid/n-butyl acrylate, ethylene/methacrylic acid/iso-butyl acrylate, ethylene/acrylic acid/iso-butyl acrylate, ethylene/methacrylic acid/n-butyl methacrylate, ethylene/acrylic acid/methyl methacrylate, ethylene/acrylic acid/methyl acrylate, ethylene/methacrylic acid/methyl acrylate, ethylene/methacrylic acid/methyl methacrylate, and ethylene/acrylic acid/n-butyl methacrylate. Preferred acid-containing ethylene copolymers include, ethylene/methacrylic acid/n-butyl acrylate, ethylene/acrylic acid/n-butyl acrylate, ethylene/methacrylic acid/methyl acrylate, ethylene/acrylic acid/ethyl acrylate, ethylene/methacrylic acid/ethyl acrylate, and ethylene/acrylic acid/methyl acrylate copolymers. The most preferred acid-containing ethylene copolymers are, ethylene/(meth) acrylic acid/n-butyl, acrylate, ethylene/(meth) acrylic acid/ethyl acrylate, and ethylene/(meth) acrylic acid/methyl acrylate copolymers.

The acid copolymer is at least partially neutralized with a cation source, optionally in the presence of a high molecular weight organic acid, such as those disclosed in U.S. Pat. No. 6,756,436, the entire disclosure of which is hereby incorporated herein by reference. Suitable cation sources include, but are not limited to, metal ions and compounds of alkali metals, alkaline earth metals, and transition metals; metal ions and compounds of rare earth elements; ammonium salts and monoamine salts; and combinations thereof. Preferred cation sources are metal ions and compounds of magnesium, sodium, potassium, cesium, calcium, barium, manganese, copper, zinc, tin, lithium, and rare earth metals.

The acid moieties may be neutralized greater than about 80%, preferably from 90-100%, most preferably 100% without losing processability. This accomplished by melt-blending an ethylene α,β-ethylenically unsaturated carboxylic acid copolymer, for example, with an organic acid or a salt of organic acid, and adding a sufficient amount of a cation source to increase the level of neutralization of all the acid moieties (including those in the acid copolymer and in the organic acid) to greater than 90%, (preferably greater than 100%).

The organic acids may be for example aliphatic, mono- or multi-functional (saturated, unsaturated, or multi-unsaturated) organic acids. Salts of these organic acids may also be employed. The salts of organic acids of the present invention include the salts of barium, lithium, sodium, zinc, bismuth, chromium, cobalt, copper, potassium, strontium, titanium, tungsten, magnesium, cesium, iron, nickel, silver, aluminum, tin, or calcium, salts of fatty acids, particularly stearic, behenic, erucic, oleic, linoelic or dimerized derivatives thereof. It is preferred that the organic acids and salts of the present invention be relatively non-migratory (they do not bloom to the surface of the polymer under ambient temperatures) and non-volatile (they do not volatilize at temperatures required for melt-blending).

The ionomers in a golf ball of the invention may also be more conventional ionomers, i.e., partially-neutralized with metal cations. The acid moiety in the acid copolymer is neutralized about 1 to about 90%, preferably at least about 20 to about 75%, and more preferably at least about 40 to about 70%, to form an ionomer, by a cation such as lithium, sodium, potassium, magnesium, calcium, barium, lead, tin, zinc, aluminum, or a mixture thereof.

Ionomers may be salts of O/X- and O/X/Y-type acid copolymers, wherein O is an α-olefin, X is a $C_3$-$C_8$ α,β-ethylenically unsaturated carboxylic acid, and Y is a softening monomer. O is preferably selected from ethylene and propylene. X is preferably selected from methacrylic acid, acrylic acid, ethacrylic acid, maleic acid, crotonic acid, fumaric acid, and itaconic acid. Methacrylic acid and acrylic acid are particularly preferred. As used herein, "(meth) acrylic acid" means methacrylic acid and/or acrylic acid. Likewise, "(meth) acrylate" means methacrylate and/or acrylate. Y is preferably selected from (meth) acrylate and alkyl (meth) acrylates wherein the alkyl groups have from 1 to 8 carbon atoms, including, but not limited to, n-butyl (meth) acrylate, isobutyl (meth) acrylate, methyl (meth) acrylate, and ethyl (meth) acrylate. Particularly preferred O/X/Y-type copolymers are ethylene/(meth) acrylic acid/n-butyl acrylate, ethylene/(meth) acrylic acid/methyl acrylate, and ethylene/(meth) acrylic acid/ethyl acrylate. Particularly suitable commercially available examples of very low acid ethylene copolymers and terpolymers include, but are not limited to, Nucrel® AE very low acid ethylene terpolymer, Nucrel® 0411HS very low acid ethylene copolymer, Nucrel® 0407 very low acid ethylene copolymer, Nucrel® 0403 very low acid ethylene copolymer, Nucrel® 0609HS very low acid ethylene copolymer, commercially available from E. I. du Pont de Nemours and Company.

The acid is typically present in the acid copolymer in an amount of 10 wt % or less, or 11 wt % or less, or 15 wt % or greater, or 16 wt % or greater, or in an amount within a range having a lower limit of 1 or 4 or 6 or 8 or 10 or 11 or 12 or 15 wt % and an upper limit of 15 or 16 or 20 or 25 or 30 or 35 or 40 wt %, based on the total weight of the acid copolymer. The ionomer may comprise low acid ionomer(s)(less than 11 wt %), medium acid (11-16 wt %) ionomer(s), high acid (>16 wt %) ionomer(s), or combinations thereof.

The ionomer may be a blend of a high acid ionomer neutralized with sodium and a high acid ionomer neutralized with zinc. A high acid ionomer is selected from sodium ionomers, lithium ionomers, zinc ionomers, magnesium ionomers, and blends of two or more thereof. For example, a 25/25/50 or 37.5/37.5/25 blend, of Surlyn® 8150 or Surlyn®8140 high acid sodium ionomer, Surlyn® 9150 or Surlyn®9120 high acid zinc ionomer. In another embodiment, a very low acid ethylene copolymer or terpolymer is highly neutralized with a fatty acid salt. Particularly suitable commercially available examples of very low acid ethylene copolymers and terpolymers include, but are not limited to, Nucrel® AE very low acid ethylene terpolymer, Nucrel® 0411HS very low acid ethylene copolymer, Nucrel® 0407 very low acid ethylene copolymer, Nucrel® 0403 very low acid ethylene copolymer, Nucrel® 0609HS very low acid ethylene copolymer, commercially available from E. I. du Pont de Nemours and Company.

Examples of commercially available ionomers include, but are not limited to, Surlyn® ionomers and DuPont® HPF 1000 and HPF 2000 highly neutralized ionomers, commercially available from E. I. du Pont de Nemours and Company; Clarix® ionomers, commercially available from A. Schulman, Inc.; Iotek® ionomers, commercially available from ExxonMobil Chemical Company; Amplify® IO ionomers, commercially available from The Dow Chemical Company; and blends of two or more thereof.

Particularly suitable ionomers also include polypropylene ionomers, including grafted polypropylene ionomers. Examples of commercially available polypropylene ionomers include, but are not limited to, Clarix® 130640 and 230620 acrylic acid-grafted polypropylene ionomers, commercially available from A. Schulman Inc., and Priex® 40101, 42101, 45101, and 48101, maleic anhydride-grafted polypropylene ionomers, commercially available from Solvay Engineered Polymers, Inc.

Particularly suitable ionomers also include polyester ionomers, including, but not limited to, those disclosed, for example, in U.S. Pat. Nos. 6,476,157 and 7,074,465, the entire disclosures of which are hereby incorporated herein by reference.

Particularly suitable ionomers also include low molecular weight ionomers, such as AClyn® 201, 201A, 295, 295A, 246, 246A, 285, and 285A low molecular weight ionomers, commercially available from Honeywell International Inc.

Particularly suitable ionomers also include ionomer compositions comprising an ionomer and potassium ions, such as those disclosed, for example, in U.S. Pat. No. 7,825,191, the entire disclosure of which is hereby incorporated herein by reference.

Additional suitable ionomers are disclosed, for example, in U.S. Patent Application Publication Nos. 2005/0049367, 2005/0148725, 2005/0020741, 2004/0220343, and 2003/0130434, and U.S. Pat. Nos. 5,587,430, 5,691,418, 5,866,658, 6,100,321, 6,562,906, 6,653,382, 6,777,472, 6,762,246, 6,815,480, and 6,953,820, the entire disclosures of which are hereby incorporated herein by reference.

Any golf ball component, namely core, intermediate layer, cover, etc. may also be formed from or comprise or include or be blended or otherwise combined or mixed with any of the following compositions as known in the art to achieve particular desired golf ball characteristics:

(1) Polyurethanes, such as those prepared from polyols and diisocyanates or polyisocyanates and/or their prepolymers, and those disclosed in U.S. Pat. Nos. 5,334,673 and 6,506,851;

(2) Polyureas, such as those disclosed in U.S. Pat. Nos. 5,484,870 and 6,835,794; and (3) Polyurethane-urea hybrids, blends or copolymers comprising urethane or urea segments.

Suitable polyurethane compositions comprise a reaction product of at least one polyisocyanate and at least one curing agent. The curing agent can include, for example, one or more polyols. The polyisocyanate can be combined with one or more polyols to form a prepolymer, which is then combined with the at least one curing agent. Thus, the polyols described herein are suitable for use in one or both components of the polyurethane material, i.e., as part of a prepolymer and in the curing agent. Suitable polyurethanes are described in U.S. Pat. No. 7,331,878, which is incorporated herein in its entirety by reference.

Any polyol available to one of ordinary skill in the art is suitable for use according to the invention. Exemplary polyols include, but are not limited to, polyether polyols, hydroxy-terminated polybutadiene (including partially/fully hydrogenated derivatives), polyester polyols, polycaprolactone polyols, and polycarbonate polyols. In one preferred embodiment, the polyol includes polyether polyol. Examples include, but are not limited to, polytetramethylene ether glycol (PTMEG), polyethylene propylene glycol, polyoxypropylene glycol, and mixtures thereof. The hydrocarbon chain can have saturated or unsaturated bonds and substituted or unsubstituted aromatic and cyclic groups. Preferably, the polyol of the present invention includes PTMEG.

In another embodiment, polyester polyols are included in the polyurethane material. Suitable polyester polyols include, but are not limited to, polyethylene adipate glycol; polybutylene adipate glycol; polyethylene propylene adipate glycol; o-phthalate-1,6-hexanediol; poly(hexamethylene adipate) glycol; and mixtures thereof. The hydrocarbon chain can have saturated or unsaturated bonds, or substituted or unsubstituted aromatic and cyclic groups. In another embodiment, polycaprolactone polyols are included in the materials of the invention. Suitable polycaprolactone polyols include, but are not limited to, 1,6-hexanediol-initiated polycaprolactone, diethylene glycol initiated polycaprolactone, trimethylol propane initiated polycaprolactone, neopentyl glycol initiated polycaprolactone, 1,4-butanediol-initiated polycaprolactone, and mixtures thereof. The hydrocarbon chain can have saturated or unsaturated bonds, or substituted or unsubstituted aromatic and cyclic groups.

In yet another embodiment, polycarbonate polyols are included in the polyurethane material of the invention. Suitable polycarbonates include, but are not limited to, polyphthalate carbonate and poly(hexamethylene carbonate) glycol. The hydrocarbon chain can have saturated or unsaturated bonds, or substituted or unsubstituted aromatic and cyclic groups. In one embodiment, the molecular weight of the polyol is from about 200 to about 4000. Polyamine curatives are also suitable for use in the polyurethane composition of the invention and have been found to improve cut, shear, and impact resistance of the resultant balls. Preferred polyamine curatives include, but are not limited to, 3,5-dimethylthio-2,4-toluenediamine and isomers thereof; 3,5-diethyltoluene-2,4-diamine and isomers thereof, such as 3,5-diethyltoluene-2,6-diamine; 4,4'-bis-(sec-butylamino)-diphenylmethane; 1,4-bis-(sec-butylamino)-benzene, 4,4'-methylene-bis-(2-chloroaniline); 4,4'-methylene-bis-(3-chloro-2,6-diethylaniline); polytetramethyleneoxide-di-p-aminobenzoate; N,N'-dialkyldiamino diphenyl methane; p,p'-methylene dianiline; m-phenylenediamine; 4,4'-methylene-bis-(2-chloroaniline); 4,4'-methylene-bis-(2,6-diethylaniline); 4,4'-methylene-bis-(2,3-dichloroaniline); 4,4'-diamino-3,3'-diethyl-5,5'-dimethyl diphenylmethane; 2,2',3,3'-tetrachloro diamino diphenylmethane; trimethylene glycol di-p-aminobenzoate; and mixtures thereof. Preferably, the curing agent of the present invention includes 3,5-dimethylthio-2,4-toluenediamine and isomers thereof, such as ETHACURE® 300, commercially available from Albermarle Corporation of Baton Rouge, La. Suitable polyamine curatives, which include both primary and secondary amines, preferably have molecular weights ranging from about 64 to about 2000.

At least one of a diol, triol, tetraol, or hydroxy-terminated curatives may be added to the aforementioned polyurethane composition. Suitable diol, triol, and tetraol groups include ethylene glycol; diethylene glycol; polyethylene glycol; propylene glycol; polypropylene glycol; lower molecular weight polytetramethylene ether glycol; 1,3-bis(2-hydroxyethoxy) benzene; 1,3-bis-[2-(2-hydroxyethoxyl)ethoxy]benzene; 1,3-bis-{2-[2-(2-hydroxyethoxyl)ethoxy]ethoxy}benzene; 1,4-butanediol; 1,5-pentanediol; 1,6-hexanediol; resorcinol-di-(β-hydroxyethyl) ether; hydroquinone-di-(β-hydroxyethyl) ether; and mixtures thereof. Preferred hydroxy-terminated curatives include 1,3-bis(2-hydroxyethoxy) benzene; 1,3-bis-[2-(2-hydroxyethoxyl)ethoxy]benzene; 1,3-bis-{2-[2-(2-hydroxyethoxyl)ethoxy]ethoxy}benzene; 1,4-butanediol, and mixtures thereof. Preferably, the hydroxy-terminated curatives have molecular weights ranging from about 48 to 2000. It should be understood that molecular weight, as used herein, is the absolute weight average molecular weight and would be understood as such by one of ordinary skill in the art.

Both the hydroxy-terminated and amine curatives can include one or more saturated, unsaturated, aromatic, and cyclic groups. Additionally, the hydroxy-terminated and amine curatives can include one or more halogen groups. The polyurethane composition can be formed with a blend or mixture of curing agents. If desired, however, the polyurethane-urea composition may be formed with a single curing agent.

In a preferred embodiment of the present invention, saturated polyurethanes are used to form one or more of the cover layers, preferably the outer cover layer, and may be selected from among both castable thermoset and thermoplastic polyurethanes.

In this embodiment, the saturated polyurethanes of the present invention are substantially free of aromatic groups or moieties. Saturated polyurethanes suitable for use in the invention are a product of a reaction between at least one polyurethane prepolymer and at least one saturated curing agent. The polyurethane prepolymer is a product formed by a reaction between at least one saturated polyol and at least one saturated diisocyanate. As is well known in the art, that a catalyst may be employed to promote the reaction between the curing agent and the isocyanate and polyol, or the curing agent and the prepolymer.

Saturated diisocyanates which can be used include, without limitation, ethylene diisocyanate; propylene-1,2-diisocyanate; tetramethylene-1,4-diisocyanate; 1,6-hexamethylene-diisocyanate (HDI); 2,2,4-trimethylhexamethylene diisocyanate; 2,4,4-trimethylhexamethylene diisocyanate; dodecane-1,12-diisocyanate; dicyclohexylmethane diisocyanate; cyclobutane-1,3-diisocyanate; cyclohexane-1,3-diisocyanate; cyclohexane-1,4-diisocyanate; 1-isocyanato-3,3,5-trimethyl-5-isocyanatomethylcyclohexane; isophorone diisocyanate; methyl cyclohexylene diisocyanate; triisocyanate of HDI; triisocyanate of 2,2,4-trimethyl-1,6-hexane diisocyanate.

Saturated polyols which are appropriate for use in this invention include without limitation polyether polyols such as polytetramethylene ether glycol and poly(oxypropylene) glycol. Suitable saturated polyester polyols include polyethylene adipate glycol, polyethylene propylene adipate glycol, polybutylene adipate glycol, polycarbonate polyol and ethylene oxide-capped polyoxypropylene diols. Saturated polycaprolactone polyols which are useful in the invention include diethylene glycol-initiated polycaprolactone, 1,4-butanediol-initiated polycaprolactone, 1,6-hexanediol-initiated polycaprolactone; trimethylol propane-initiated polycaprolactone, neopentyl glycol initiated polycaprolactone, and polytetramethylene ether glycol-initiated polycaprolactone. The most preferred saturated polyols are polytetramethylene ether glycol and PTMEG-initiated polycaprolactone.

Suitable saturated curatives include 1,4-butanediol, ethylene glycol, diethylene glycol, polytetramethylene ether glycol, propylene glycol; trimethanolpropane; tetra-(2-hydroxypropyl)-ethylenediamine; isomers and mixtures of isomers of cyclohexyldimethylol, isomers and mixtures of isomers of cyclohexane bis(methylamine); triisopropanolamine; ethylene diamine; diethylene triamine; triethylene tetramine; tetraethylene pentamine; 4,4'-dicyclohexylmethane diamine; 2,2,4-trimethyl-1,6-hexanediamine; 2,4,4-trimethyl-1,6-hexanediamine; diethyleneglycol di-(aminopropyl)ether; 4,4'-bis-(sec-butylamino)-dicyclohexylmethane; 1,2-bis-(sec-butylamino)cyclohexane; 1,4-bis-(sec-butylamino) cyclohexane; isophorone diamine; hexamethylene diamine; propylene diamine; 1-methyl-2,4-cyclohexyl diamine; 1-methyl-2,6-cyclohexyl diamine; 1,3-diaminopropane; dimethylamino propylamine; diethylamino propylamine; imido-bis-propylamine; isomers and mixtures of isomers of diaminocyclohexane; monoethanolamine; diethanolamine; triethanolamine; monoisopropanolamine; and diisopropanolamine. The most preferred saturated curatives are 1,4-butanediol, 1,4-cyclohexyldimethylol and 4,4'-bis-(sec-butylamino)-dicyclohexylmethane.

Alternatively, other suitable polymers include partially or fully neutralized ionomer, metallocene, or other single-site catalyzed polymer, polyester, polyamide, non-ionomeric thermoplastic elastomer, copolyether-esters, copolyetheramides, polycarbonate, polybutadiene, polyisoprene, polystryrene block copolymers (such as styrene-butadiene-styrene), styrene-ethylene-propylene-styrene, styrene-ethylene-butylene-styrene, and the like, and blends thereof. Thermosetting polyurethanes or polyureas are suitable for the outer cover layers of the golf balls of the present invention.

Additionally, the polyurethane can be replaced with or blended with a polyurea material. Polyureas are distinctly different from polyurethane compositions, but also result in desirable aerodynamic and aesthetic characteristics when used in golf ball components. The polyurea-based compositions are preferably saturated in nature.

Without being bound to any particular theory, it is now believed that substitution of the long chain polyol segment in the polyurethane prepolymer with a long chain polyamine oligomer soft segment to form a polyurea prepolymer, improves shear, cut, and resiliency, as well as adhesion to other components. Thus, the polyurea compositions of this invention may be formed from the reaction product of an isocyanate and polyamine prepolymer crosslinked with a curing agent. For example, polyurea-based compositions of the invention may be prepared from at least one isocyanate, at least one polyether amine.

Any polyamine available to one of ordinary skill in the art is suitable for use in the polyurea prepolymer. Polyether amines are particularly suitable for use in the prepolymer. As used herein, "polyether amines" refer to at least polyoxyalkyleneamines containing primary amino groups attached to the terminus of a polyether backbone. Due to the rapid reaction of isocyanate and amine, and the insolubility of many urea products, however, the selection of diamines and polyether amines is limited to those allowing the successful formation of the polyurea prepolymers. In one embodiment, the polyether backbone is based on tetramethylene, propylene, ethylene, trimethylolpropane, glycerin, and mixtures thereof.

Suitable polyether amines include, but are not limited to, methyldiethanolamine; polyoxyalkylenediamines such as, polytetramethylene ether diamines, polyoxypropylenetriamine, and polyoxypropylene diamines; poly(ethylene oxide capped oxypropylene) ether diamines; propylene oxide-based triamines; triethyleneglycoldiamines; trimethylolpropane-based triamines; glycerin-based triamines; and mixtures thereof. In one embodiment, the polyether amine used to form the prepolymer is JEFFAMINE® D2000 (manufactured by Huntsman Chemical Co. of Austin, Tex.).

The molecular weight of the polyether amine for use in the polyurea prepolymer may range from about 100 to about 5000. In one embodiment, the polyether amine molecular weight is about 200 or greater, preferably about 230 or greater. In another embodiment, the molecular weight of the polyether amine is about 4000 or less. In yet another embodiment, the molecular weight of the polyether amine is about 600 or greater. In still another embodiment, the molecular weight of the polyether amine is about 3000 or less. In yet another embodiment, the molecular weight of the polyether amine is between about 1000 and about 3000, and more preferably is between about 1500 to about 2500. Because lower molecular weight polyether amines may be prone to forming solid polyureas, a higher molecular weight oligomer, such as JEFFAMINE® D2000, is preferred.

As briefly discussed above, some amines may be unsuitable for reaction with the isocyanate because of the rapid reaction between the two components. In particular, shorter chain amines are fast reacting. In one embodiment, however, a hindered secondary diamine may be suitable for use in the prepolymer. Without being bound to any particular theory, it is believed that an amine with a high level of stearic hindrance, e.g., a tertiary butyl group on the nitrogen atom, has a slower reaction rate than an amine with no hindrance or a low level of hindrance. For example, 4,4'-bis-(sec-butylamino)-dicyclohexylmethane (CLEARLINK® 1000) may be suitable for use in combination with an isocyanate to form the polyurea prepolymer.

The number of unreacted NCO groups in the polyurea prepolymer may be varied to control such factors as the speed of the reaction, the resultant hardness of the composition, and the like. For instance, the number of unreacted NCO groups in the polyurea prepolymer and polyether amine may be less than about 14 percent. In one embodiment, the polyurea prepolymer has from about 5 percent to about 11 percent unreacted NCO groups, and even more preferably has from about 6 to about 9.5 percent unreacted NCO groups. In one embodiment, the percentage of unreacted NCO groups is about 3 percent to about 9 percent. Alternatively, the percentage of unreacted NCO groups in the polyurea prepolymer may be about 7.5 percent or less, and more preferably, about 7 percent or less. In another embodiment, the unreacted NCO content is from about 2.5 percent to about 7.5 percent, and more preferably from about 4 percent to about 6.5 percent.

When formed, polyurea prepolymers may contain about 10 percent to about 20 percent by weight of the prepolymer of free isocyanate monomer. Thus, in one embodiment, the polyurea prepolymer may be stripped of the free isocyanate monomer. For example, after stripping, the prepolymer may contain about 1 percent or less free isocyanate monomer. In another embodiment, the prepolymer contains about 0.5 percent by weight or less of free isocyanate monomer.

The polyether amine may be blended with additional polyols to formulate copolymers that are reacted with excess isocyanate to form the polyurethane/polyurea hybrid. In one embodiment, less than about 30 percent polyol by weight of the copolymer is blended with the saturated polyether amine. In another embodiment, less than about 20 percent polyol by weight of the copolymer, preferably less than about 15 percent by weight of the copolymer, is blended with the polyether amine. The polyols listed above with respect to the polyurethane prepolymer, e.g., polyether polyols, polycaprolactone polyols, polyester polyols, polycarbonate polyols, hydrocarbon polyols, other polyols, and mixtures thereof, are also suitable for blending with the polyether amine. The molecular weight of these polymers may be from about 200 to about 4000, but also may be from about 1000 to about 3000, and more preferably are from about 1500 to about 2500.

The polyurea composition can be formed by crosslinking the polyurea prepolymer with a single curing agent or a blend of curing agents. The curing agent of the invention is preferably an amine-terminated curing agent, more preferably a secondary diamine curing agent so that the composition contains only urea linkages. In one embodiment, the amine-terminated curing agent may have a molecular weight of about 64 or greater. In another embodiment, the molecular weight of the amine-curing agent is about 2000 or less. As discussed above, certain amine-terminated curing agents may be modified with a compatible amine-terminated freezing point depressing agent or mixture of compatible freezing point depressing agents.

Suitable amine-terminated curing agents include, but are not limited to, ethylene diamine; hexamethylene diamine; 1-methyl-2,6-cyclohexyl diamine; tetrahydroxypropylene ethylene diamine; 2,2,4- and 2,4,4-trimethyl-1,6-hexanediamine; 4,4'-bis-(sec-butylamino)-dicyclohexylmethane; 1,4-bis-(sec-butylamino)-cyclohexane; 1,2-bis-(sec-butylamino)-cyclohexane; derivatives of 4,4'-bis-(sec-butylamino)-dicyclohexylmethane; 4,4'- dicyclohexylmethane diamine; 1,4-cyclohexane-bis-(methylamine); 1,3-cyclohexane-bis-(methylamine); diethylene glycol di-(aminopropyl) ether; 2-methylpentamethylene-diamine; diaminocyclohexane; diethylene triamine; triethylene tetramine; tetraethylene pentamine; propylene diamine; 1,3-diaminopropane; dimethylamino propylamine; diethylamino propylamine; dipropylene triamine; imido-bis-propylamine; monoethanolamine, diethanolamine; triethanolamine; monoisopropanolamine, diisopropanolamine; isophoronediamine; 4,4'-methylenebis-(2-chloroaniline); 3,5; dimethylthio-2,4-toluenediamine; 3,5-dimethylthio-2,6-toluenediamine; 3,5-diethylthio-2,4-toluenediamine; 3,5; diethylthio-2,6-toluenediamine; 4,4'-bis-(sec-butylamino)-diphenylmethane and derivatives thereof; 1,4-bis-(sec-butylamino)-benzene; 1,2-bis-(sec-butylamino)-benzene; N,N'-dialkylamino-diphenylmethane; N,N,N',N'-tetrakis (2-hydroxypropyl) ethylene diamine; trimethyleneglycol-di-p-aminobenzoate; polytetramethyleneoxide-di-p-aminobenzoate; 4,4'-methylenebis-(3-chloro-2,6-diethyleneaniline); 4,4'-methylenebis-(2,6-diethylaniline); meta-phenylenediamine; paraphenylenediamine; and mixtures thereof. In one embodiment, the amine-terminated curing agent is 4,4'-bis-(sec-butylamino)-dicyclohexylmethane.

Suitable saturated amine-terminated curing agents include, but are not limited to, ethylene diamine; hexamethylene diamine; 1-methyl-2,6-cyclohexyl diamine; tetrahydroxypropylene ethylene diamine; 2,2,4- and 2,4,4-trimethyl-1,6-hexanediamine; 4,4'-bis-(sec-butylamino)-dicyclohexylmethane; 1,4-bis-(sec-butylamino)-cyclohexane; 1,2-bis-(sec-butylamino)-cyclohexane; derivatives of 4,4'-bis-(sec-butylamino)-dicyclohexylmethane; 4,4'-dicyclohexylmethane diamine; 4,4'-methylenebis-(2,6-diethylaminocyclohexane; 1,4-cyclohexane-bis-(methylamine); 1,3-cyclohexane-bis-(methylamine); diethylene glycol di-(aminopropyl) ether; 2-methylpentamethylene-diamine; diaminocyclohexane; diethylene triamine; triethylene tetramine; tetraethylene pentamine; propylene diamine; 1,3-diaminopropane; dimethylamino propylamine; diethylamino propylamine; imido-bis-propylamine; monoethanolamine, diethanolamine; triethanolamine; monoisopropanolamine, diisopropanolamine; isophoronediamine; triisopropanolamine; and mixtures thereof. In addition, any of the polyether amines listed above may be used as curing agents to react with the polyurea prepolymers.

In one embodiment of a golf ball of the invention, the cover comprises an opaque or translucent thermoset or thermoplastic aliphatic is ocyanate-based material.

A core hardness gradient as measured radially outward from core geometric center to outer surface may be positive, negative or zero (substantially the same hardness). Cores may have a hardness gradient defined by hardness measurements made at the center of the inner core and radially outward towards the outer surface, typically at 2-mm increments. As used herein, the terms "negative" and "positive" refer to the result of subtracting the hardness value at the innermost portion of the component being measured (e.g., the center of a solid core or an inner core in a dual core construction; the inner surface of a core layer; etc.) from the hardness value at the outer surface of the component being measured (e.g., the outer surface of a solid core; the outer surface of an inner core in a dual core; the outer surface of an outer core layer in a dual core, etc.). For example, if the outer surface of a solid core has a lower hardness value than the center (i.e., the surface is softer than the center), the hardness gradient will be deemed a "negative" gradient (a smaller number−a larger number=a negative number).

The flexural modulus of the cover material of a golf ball of the invention may be evaluated according to ASTM D-790.

Compression values are dependent on the diameter of the component being measured. The Dynamic Compression Machine ("DCM") is an apparatus that applies a load to a core or ball and measures the number of inches the core or ball is deflected at measured loads. A load/deflection curve is generated that is fit to the Atti compression scale that results in a number being generated representing an Atti compression. The DCM does this via a load cell attached to the bottom of a hydraulic cylinder that is triggered pneumatically at a fixed rate (typically about 1.0 ft/s) towards a stationary core. Attached to the cylinder is an LVDT that measures the distance the cylinder travels during the testing timeframe. A software-based logarithmic algorithm ensures that measurements are not taken until at least five successive increases in load are detected during the initial phase of the test. DCM is often used to capture compressions that fall outside the Atti compression scale range of −75 to 200, since the DCM scale compression range is −246 to 200

COR, as used herein, is determined by firing a golf ball or golf ball subassembly (e.g., a golf ball core) from an air cannon at two given velocities and calculating the COR at a velocity of 125 ft/s. Ball velocity is calculated as a ball approaches ballistic light screens which are located between the air cannon and a steel plate at a fixed distance. As the ball travels toward the steel plate, each light screen is activated, and the time at each light screen is measured. This provides an incoming transit time period inversely proportional to the ball's incoming velocity. The ball impacts the steel plate and rebounds though the light screens, which again measure the time period required to transit between the light screens. This provides an outgoing transit time period inversely proportional to the ball's outgoing velocity. COR is then calculated as the ratio of the outgoing transit time period to the incoming transit time period, $COR==V_{out}/V_{in}=T_{in}/T_{out}$. The COR value can be targeted by varying the peroxide and antioxidant types and amounts as well as the cure temperature and duration. The COR value can be targeted by varying the peroxide and antioxidant types and amounts as well as the cure temperature and duration.

The cover of the golf ball of the present invention may comprise any known color and optionally comprise surface off-sets, or depressions or projections, on its surface. Surface off-sets include dimples and marking other than dimples. For instance, the surface of the translucent cover may comprise depressed logos, text, lines, arcs, circles or polygons. The surface may also comprise raised projections in the form of logos, text, lines, arcs, circles or polygons. The inclusion of such surface off-sets on the translucent cover creates a unique visual effect, as the juxtaposition of thick and thin portions of the translucent cover material creates a "shadow" effect on the opaque surface below the translucent cover.

While any of the embodiments herein may have any known dimple number and pattern, such as a number of dimples being 252 to 456, or 330 to 392. The dimples may comprise any width, depth, and edge angle disclosed in the prior art and the patterns may comprises multitudes of dimples having different widths, depths and edge angles. The parting line configuration of said pattern may be either a straight line or a staggered wave parting line (SWPL). Most preferably the dimple number is 330, 332, or 392 and comprises 5 to 7 dimples sizes and the parting line is a SWPL.

In any of these embodiments the single-layer core may be replaced with a 2 or more layer core wherein at least one core layer has a hardness gradient.

Other than in the operating examples, or unless otherwise expressly specified, all of the numerical ranges, amounts, values and percentages such as those for amounts of materials and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Several embodiments of a golf ball of the invention incorporating photonic pigments are illustrated in prophetic golf balls Ex. 1, Ex. 2, Ex. 3, and Ex. 4 of TABLE I below. In this regard, at least one golf ball layer in each of golf balls Ex. 1, Ex. 2, Ex. 3, Ex. 4 includes photonic pigments, their respective constructions and formulas set forth in TABLE I as follows:

TABLE I

| GOLF BALL CONSTRUCTION & PROPERTIES | INGREDIENTS (Phr) | EXAMPLES EX. 1 | EX. 2 | EX. 3 | EX. 4 |
|---|---|---|---|---|---|
| Core Diameter | | 1.53 | 1.55 | 1.58 | 1.55 |
| Core Formulation | Polybutadiene | 100 | 100 | 100 | 100 |
| | Zinc Diacrylate | 30 | 35 | 32 | 36 |
| | Zinc Oxide | 5 | 5 | 5 | 5 |
| | Dicumyl Peroxide | 0.8 | 0.5 | 0.5 | 0.5 |
| | ZnPCTP | 0.5 | 0.5 | — | 0.5 |
| | Vulkanox BKF | 0.4 | — | — | — |
| | Barium Sulfate | Varied as desired to adjust density | | | |
| Intermediate Layer Thickness (in.) | — | 0.045 | 0.035 | — | 0.035 |
| Intermediate Layer Formulation | Ionomer Blend | 97 | 92 | — | 100 |
| | TiO2 | 3 | 3 | — | — |
| | Photonic Pigment | — | 5 | — | — |
| Cover Thickness (in.) | — | 0.03 | 0.03 | 0.05 | 0.03 |
| Cover Formulation | Cast Urethane Elastomer | 99 | 100 | — | 100 |
| | Ionomer Blend | — | — | 94 | — |
| | Photonic Pigment | 1 | | 6 | — |
| Coating Thickness (μm) | — | 14 | 14 | 12 | 14 |
| Coating Formulation | Urethane Clear Coat | 100 | 100 | 100 | 99 |
| | Photonic Pigment | — | — | — | 1 |
| Overall golf ball color appearance | — | Orange Shade A | Orange Shade B | Yellow | Green |

Golf balls Ex. 1, Ex. 2, Ex. 3, and Ex. 4 of TABLE I would exhibit superior color retention over time as compared with golf balls incorporating purely conventional chromosphore-based coloring agents. Referring to TABLE I, golf balls Ex. 1 and Ex. 3 include photonic pigments in a cover layer. In this regard, the cover of golf ball Ex. 1 is formed from a cast urethane elastomer layer composition and photonic pigments in amounts of 99 phr and 1 phr, respectively. Meanwhile, the cover of golf ball Ex. 3 is formed from an ionomer blend layer composition and photonic pigments in amounts of 94 phr and 6 phr, respectively.

The resulting color of golf ball Ex. 1 is orange, whereas the resulting color golf ball Ex. 3 is yellow. This color difference may be achieved by targeting the photonic pigment sizing and spacing of nanoparticles within each microcapsule. Meanwhile, the shade of orange or yellow may be deepened by increasing the microcapsule loading (phr) within each layer.

Golf balls Ex. 1 and Ex. 3 further differ in that golf ball Ex. 1 additionally comprises $TiO_2$ in the cover layer formulation in an amount of 3 phr. $TiO_2$ or titanium dioxide pigment has been used in conventional golf balls to optimize the scattering of visible light and produce a color appearance of white opacity. The intermediate layer of Ex. 1 comprising $TiO_2$ will also contribute to golf ball Ex. 1's overall color appearance along with the photonic pigments within the cover layer where both the cover layer and coating layer composition are translucent or transparent.

Meanwhile, in golf ball Ex 2, photonic pigments are incorporated in the ionomeric intermediate layer rather than in its urethane cover. The ionomeric composition, the photonic pigments as well as $TiO_2$ are included in the intermediate layer in amounts of 97 phr, 3 phr and 5 phr, respectively. The resulting color of golf ball Ex 2, like that of golf ball Ex. 1, is orange. However, the shade of orange produced for golf ball Ex 2 would differ from that produced in golf ball Ex 1 due to differences in microcapsules loading within each layer as well as because the $TiO_2$ and photonic pigments are incorporated in the same intermediate layer in golf ball Ex 2, whereas in golf ball Ex. 1 the $TiO_2$ and photonic pigments are incorporated in different layers.

Lastly, golf ball Ex. 4 comprises photonic pigments in its coating layer, wherein the microcapsules have nanoparticles sized and spaced therein so as to produce an overall golf ball color appearance of green. This coating layer is formed of a urethane clear coat and photonic pigments in amounts of 99 phr and 1 phr, respectively.

Regarding golf ball construction, the dimensions of each golf ball component such as the diameter of the core and respective thicknesses of the intermediate layer (s), cover layer(s) and coating layer(s) may be selected and coordinated as known in the art for targeting and achieving desired playing characteristics or feel. For example, the core may have a diameter of from about 1.47 inches (in.) to about 1.55 in. The intermediate layer may have a thickness of from about 0.025 in. to about 0.057 in. The core and intermediate layer, combined, may have a diameter of from about 1.57 in. to about 1.65 in. The cover may have a thickness of from about 0.015 in. to about 0.055 in. The coating layers may have a combined thickness, for example, of from about 0.1 μm to about 100 μm, or from about 2 μm to about 50 μm, or from about 2 μm to about 30 μm. Meanwhile, each coating layer may have a thickness of from about 0.1 μm to about 50 μm, or from about 0.1 μm to about 25 μm, or from about 0.1 μm to about 14 μm, or from about 2 μm to about 9 μm.

Notwithstanding that the numerical ranges and parameters setting forth the broad scope of the invention are approximations, the numerical values set forth in the specific examples are reported as precisely as possible. Any numerical value, however, inherently contain certain errors necessarily resulting from the standard deviation found in their respective testing measurements. Furthermore, when numerical ranges of varying scope are set forth herein, it is contemplated that any combination of these values inclusive of the recited values may be used.

While it is apparent that the illustrative embodiments of the invention disclosed herein fulfill the objective stated above, it is appreciated that numerous modifications and other embodiments may be devised by those skilled in the art.

Therefore, it will be understood that the appended claims are intended to cover all such modifications and embodiments, which would come within the spirit and scope of the present invention.

What is claimed is:

1. A golf ball comprising a photonic pigmented layer formed from a layer composition and photonic pigments comprised of microcapsules having nanoparticles therein to create a predetermined overall golf ball color appearance.

2. The golf ball of claim 1, wherein the microcapsule is UV cured.

3. The golf ball of claim 1, wherein each microcapsule has a diameter of from about 50 μm to about 150 μm.

4. The golf ball of claim 1, wherein each nanoparticle comprises a nanoparticle core surrounded by a nanoparticle shell, the nanoparticle core having a diameter of from about 50 nm to about 100 nm, and the nanoparticle core and nanoparticle shell, combined, having a diameter of from about 120 nm to about 300 nm.

5. The golf ball of claim 4, wherein the nanoparticle core and the shell are formed from different compositions.

6. The golf ball of claim 1, wherein the photonic pigmented layer comprises a cover layer.

7. The golf ball of claim 1, wherein the photonic pigmented layer comprises a coating layer disposed about a cover layer.

8. The golf ball of claim 6, wherein the layer composition comprises at least one of an ionomer and a urethane.

9. The golf ball of claim 7, wherein the layer composition comprises at least one of a latex, a lacquer, and an enamel.

10. The golf ball of claim 9, wherein the layer composition comprises at least one of an acrylic, an epoxy, a urethane acrylate, and an alkyd.

11. The golf ball of claim 1, wherein the layer composition is transparent or translucent.

* * * * *